US012338599B2

(12) United States Patent
Kaufman et al.

(10) Patent No.: US 12,338,599 B2
(45) Date of Patent: Jun. 24, 2025

(54) FOUNDATION SUPPORT SYSTEMS, ASSEMBLIES AND METHODS INCLUDING SLEEVE COUPLER AND SHAFTS WITH TORQUE TRANSMITTING PROFILED DISTAL END EDGES

(71) Applicant: PIER TECH SYSTEMS, LLC, Chesterfield, MO (US)

(72) Inventors: Kevin Kaufman, Des Peres, MO (US); Michael D. Wilkis, Ellisville, MO (US)

(73) Assignee: Pier Tech Systems, LLC, Chesterfield, MO (US)

( * ) Notice: Subject to any disclaimer, the term of this patent is extended or adjusted under 35 U.S.C. 154(b) by 68 days.

(21) Appl. No.: 18/351,589

(22) Filed: Jul. 13, 2023

(65) Prior Publication Data

US 2024/0018734 A1 Jan. 18, 2024

Related U.S. Application Data

(60) Provisional application No. 63/389,999, filed on Jul. 18, 2022.

(51) Int. Cl.
*E02D 5/52* (2006.01)
*E02D 5/56* (2006.01)
(Continued)

(52) U.S. Cl.
CPC ..... *E02D 5/526* (2013.01); *E02D 5/56* (2013.01); *E02D 7/02* (2013.01); *E02D 7/22* (2013.01);
(Continued)

(58) Field of Classification Search
CPC ..... E02D 5/526; E02D 5/56; E02D 5/523; E02D 5/801; E02D 7/22
See application file for complete search history.

(56) References Cited

U.S. PATENT DOCUMENTS 1,781,091 A * 11/1930 Wilson ..... E21B 17/046 285/333
4,512,596 A * 4/1985 Obrecht ..... F16D 1/02 285/330
(Continued)

FOREIGN PATENT DOCUMENTS

CN 110984148 A 4/2020
EP 2265848 B1 8/2015
(Continued)

OTHER PUBLICATIONS

Extended European Search Report issued for Application No. 23185902.6, on Dec. 8, 2023 (34 pages).

*Primary Examiner* — Amber R Anderson
*Assistant Examiner* — Stacy N Lawson
(74) *Attorney, Agent, or Firm* — Armstrong Teasdale LLP

(57) ABSTRACT

Coupled shaft assemblies for a foundation support system include shafts provided with profiled distal end edges that may be directly engaged to one another to realize an interlocking torque transmitting relationship with one another along a curved engagement surface. A coupler sleeve may snugly receive the distal ends of the directly engaged shafts and may fasten the shafts to one another through the coupler sleeve with ease in an economical manufacture that does not require non-uniform wall thickness in the shafts to establish torque transmission capability.

40 Claims, 14 Drawing Sheets

(51) Int. Cl.
*E02D 7/22* (2006.01)
*E02D 7/02* (2006.01)

(52) U.S. Cl.
CPC .. *E02D 2300/0029* (2013.01); *E02D 2600/20* (2013.01)

(56) References Cited

U.S. PATENT DOCUMENTS

| | | | | |
|---|---|---|---|---|
| 4,821,818 | A * | 4/1989 | Mefferd | E21B 17/046 175/323 |
| 6,615,554 | B2 * | 9/2003 | Rupiper | E02D 5/801 52/165 |
| 7,748,932 | B2 | 7/2010 | Lindsey | |
| 2011/0217125 | A1 * | 9/2011 | Kasprick | E02D 13/04 405/252.1 |
| 2016/0230364 | A1 * | 8/2016 | Stroyer | F16D 1/02 |
| 2018/0030681 | A1 * | 2/2018 | Stroyer | E02D 5/36 |
| 2019/0127940 | A1 | 5/2019 | Kaufman et al. | |
| 2019/0249387 | A1 | 8/2019 | Horie et al. | |

FOREIGN PATENT DOCUMENTS

| | | | | |
|---|---|---|---|---|
| EP | 2529075 | B1 | 10/2016 | |
| JP | 2018066152 | A | 4/2018 | |
| KR | 101118318 | B1 | 3/2012 | |
| KR | 2018112642 | A * | 10/2018 | E02D 5/523 |
| KR | 2020102637 | A * | 9/2020 | |
| KR | 102195847 | B1 | 12/2020 | |

* cited by examiner

STATE OF THE ART

STATE OF THE ART

Section A-A

Section B-B

FOUNDATION SUPPORT SYSTEMS, ASSEMBLIES AND METHODS INCLUDING SLEEVE COUPLER AND SHAFTS WITH TORQUE TRANSMITTING PROFILED DISTAL END EDGES

CROSS REFERENCE TO RELATED APPLICATIONS

This application claims the benefit of U.S. Provisional Application Ser. No. 63/389,999 filed Jul. 18, 2022, the complete disclosure of which is hereby incorporated by reference in its entirety.

BACKGROUND OF THE INVENTION

The present invention relates generally to building foundation support systems including assemblies of structural support shaft components, and more specifically to mechanical, torque transmitting connections between foundation support shaft components such as helical piers.

If a building foundation moves or settles in the course of construction, or at any time after construction is completed, such movement or settlement may affect the integrity of the building structure and lead to costly repairs. While much care is taken to construct stable foundations in new building projects, certain soil types or other building site conditions, or certain types of buildings or structures, may present particular concerns that call for additional measures to ensure the stability of building foundations.

Helical piers, also known as anchors, piles or screwpiles, are deep foundation solutions commonly used when standard foundation solutions are problematic. Helical piers are driven into the ground with reduced installation time and little soil disturbance compared to large excavation work that may otherwise be required by standard foundation techniques, and a number of helical piers may be installed at designated locations to transfer and distribute the weight of the building structure to load bearing soil to prevent the foundation from moving or shifting. Lifting elements, support brackets or load-bearing caps may be used in combination with the helical piers to construct various types of foundation support systems meeting different needs for both foundation repair and new construction applications.

While known foundation support systems are satisfactory in many aspects, improvements are nonetheless desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

In order to understand the inventive concepts described herein to their fullest extent, some discussion of the state of the art and certain problems and disadvantages that exist in the art is set forth below, followed by exemplary embodiments of improved foundation support systems and components therefore which overcome such problems and disadvantages in the art.

Figure 1:
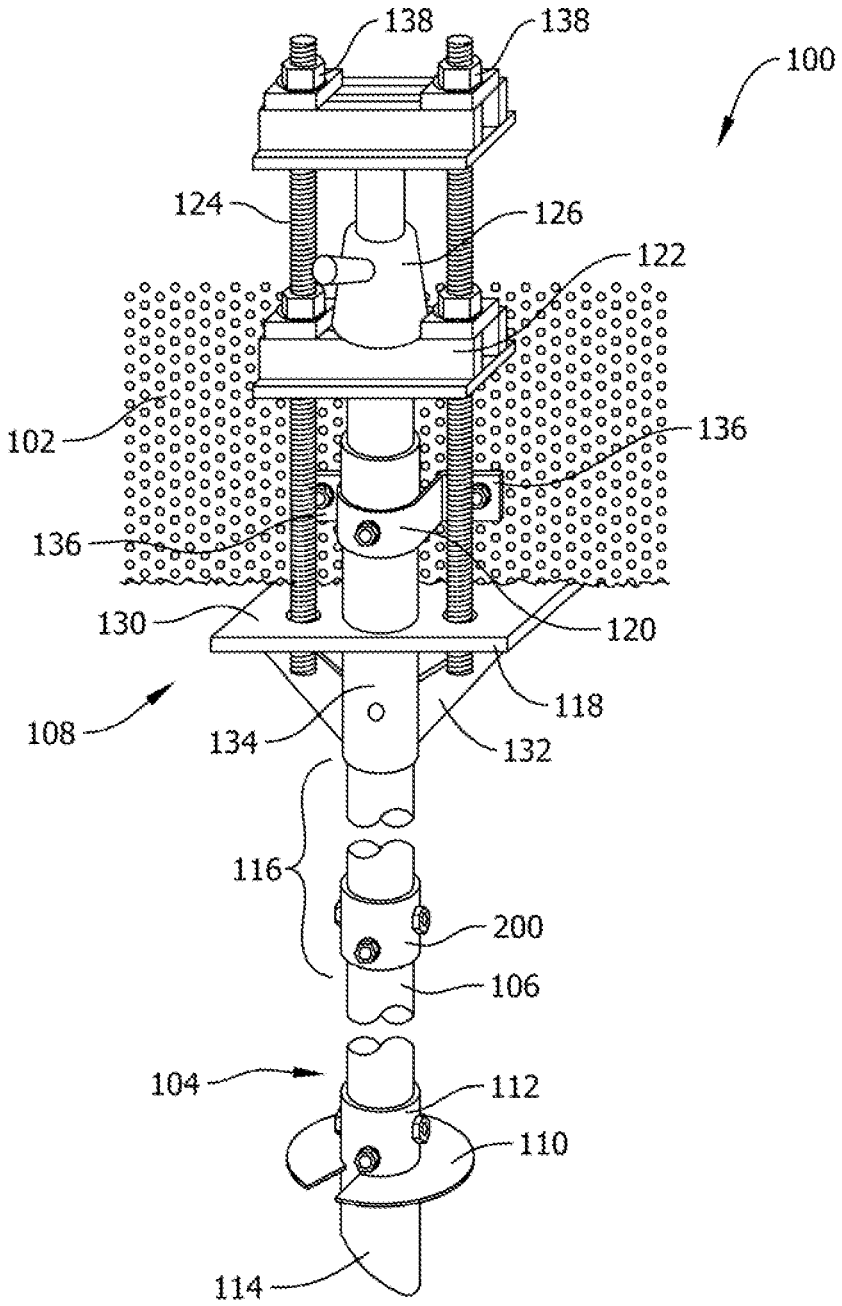
FIG. 1 is a perspective view of a conventional foundation support system interacting with a building structure.

FIG. 1 illustrates a perspective view of a conventional foundation support system 100 in combination with a building foundation 102 which in turn supports a structure in a residential, commercial or industrial construction site. The structure being supported by the building foundation 102 may include various types of buildings, homes, edifices, etc. in real estate developments and improvements. The foundation support system 100 may be applied in the new construction of the building foundation 102 prior to the structure being completed, or may alternatively be applied for maintenance and repair purposes in a retrofit manner to a pre-existing building foundation at any desired time after the foundation 102 and building structure are initially constructed. While exemplary structures are mentioned above, the foundation support system 100 may be used in a similar manner to provide foundation support for various different types of structures and to securely support anticipated structural loads without more extensive excavation that standard building foundations otherwise require to provide a similar degree of support. The foundation support system described and illustrated herein is therefore a non-limiting example of the type of system that may be benefit from the inventive concepts described further below.

Primary piles or pipe shafts (hereinafter collectively referred to as a "pile" or "piles") 104 of appropriate size and dimension may be selected and may be driven into the ground or earth at a location proximate or near the foundation 102 using known methods and techniques. The size of the primary pile 104 and the insertion depth needed to provide the desired support may be determined according to known engineering methodology and analysis of the construction site and the particular structure that is to be supported. The primary piles 104 typically consist of a long shaft 106 that is driven into the ground to the desired depth, and a support element such as a plate or bracket (not shown) or a lifting element such as a lifting assembly 108 may be assembled to the shaft 106 proximate the foundation 102. The shaft 106 of the primary pile 104 may also include one or more lateral projections such as a helical auger 110. Such helical steel piles 104 are available from, for example, Pier Tech Systems (www.piertech.com) of Chesterfield, Missouri.

The helical auger 110 may in some embodiments be separately provided from the piling 104 and attached to the piling 104 by welding to a sleeve 112 including the auger 110 provided as a modular element fitting. As such, the sleeve 112 of the modular fitting may be slidably inserted over an end of the shaft 106 of the piling shaft 104 and secured into place with fasteners such as bolts as shown in FIG. 1. In such an embodiment, the sleeve 112 includes one or more pairs of fastener holes or openings for attachment to the piling shaft 106 with the fasteners shown. In the embodiment illustrated there are two pairs of fastener holes formed in the sleeve 112, which are aligned with corresponding fastener holes in the shaft 106 to accept orthogonally-oriented fasteners and establish a cross-bolt connection between the shaft 106 and the sleeve 112. To make a primary pile 104 with a particular length one merely slides the sleeve 112 onto a piling shaft 106 of the desired length and affixes the sleeve 112 in place. In the illustrated embodiment, the end of the piling shaft 106 is provided with a beveled tip 114 to better penetrate the ground during installation of the pile 104. In different embodiments, the tapered tip 114 may be provided on the shaft 106 of the piling 104, or alternatively, the tip 114 may be a feature of the modular fitting including the sleeve 112 and the auger 110.

The lifting assembly 108 may be attached to an upper end of the primary pile 104 after being driven into the ground. If the primary pile 104 is not sufficiently long enough to be driven far enough into the ground to provide the necessary support to the foundation 102, one or more extension piles 116 can be added to the primary pile 104 to extend its length in the assembly. The lifting assembly 108 may then be attached to one of the extension piles 116.

As shown in FIG. 1, the lifting assembly 108 interacts with the foundation 102 to support and lift the building foundation 102. In a contemplated embodiment, the lifting assembly 108 may include a bracket body 118, one or more bracket clamps 120 and accompanying fasteners, a slider block 122, and one or more supporting bolts 124 (comprising allthread rods, for example) and accompanying hardware. In another suitable embodiment the lifting assembly 108 may also include a jack 126 and a jacking block 128. Suitable lifting assemblies may correspond to those available from Pier Tech Systems (www.piertech.com) of Chesterfield, Missouri, including for example only the TRU-LIFT® bracket of Pier Tech Systems, although other lifting assemblies, lift brackets, and lift components from other providers may likewise be utilized in other embodiments.

The bracket body 118 in the example shown includes a generally flat lift plate 130, one or more optional gussets 132, and a generally cylindrical housing 134. The lift plate 130 is inserted under and interacts with the foundation or other structure 102 that is to be lifted or supported. The lift plate 130 includes an opening, with which the cylindrical housing 134 is aligned to accommodate one of the primary pile 104 or an extension pile 116. The housing 134 is generally perpendicular to the surface of lift plate 130 and extends above and below the plane of lift plate 130.

In the example shown, one or more gussets 132 are attached to the bottom surface of the lift plate 130 as well as to the lower portion of the housing 134 to increase the holding strength of the lift plate 130. In one embodiment, the gussets 132 are attached to the housing 134 by welding, although other secure means of attachment are encompassed within this invention.

In the example shown, the bracket clamps 120 include a generally Ω-shaped piece having a center hole at the apex of the "Ω" to accommodate a fastener. The Ω-shaped bracket clamp 120 includes ends 136, extending laterally, that include openings to accommodate fasteners. The fasteners extending through the openings in the ends 136 are attached to the foundation 102, while the fastener extending through the center opening at the apex of the "Ω" extends into an opening in the housing 134. In one embodiment the fastener extending through the center opening in the bracket clamp 120 and into the housing 134 further extends through one of the primary pile 104 or the extension pile 116 and into an opening on the opposite side of the housing 134, and then anchors into the foundation 102. In such cases, however, the fastener is not inserted through one of the primary pile 104 or the extension pile 116 until jacking or lifting has been completed, since bracket body 118 must be able to move relative to pile 104 or 116 in order to effect lifting of the foundation 102.

In one embodiment, the bracket body 118 is raised by tightening a pair of nuts 138 attached to the top ends of the supporting bolts 124. The nuts 138 may be tightened simultaneously, or alternatively, in succession in small increments with each step, so that the tension on the bolts 124 is kept roughly equal throughout the lifting process. In another suitable embodiment, the jack 126 is used to lift the bracket body 118. In this embodiment, longer support bolts 124 are provided and are configured to extend high enough above the slider block 122 to accommodate the jack 126 resting on the slider block 122, the jacking block 128, and the nuts 138.

When all of the components are in place as shown and sufficiently tightened, the jack 126 (of any type, although a hydraulic jack is preferred) is activated so as to lift the jacking plate 128. As the jacking plate 128 is lifted, force is transferred from the jacking plate 128 to the support bolts 124 and in turn to the lift plate 130 of the bracket body 118. When the foundation 102 has been lifted to the desired elevation, the nuts immediately above the slider block 122 (which are raised along with support bolts 124 during jacking) are tightened down, with approximately equal tension placed on each nut. At this point, the jack 126 can then be lowered while the bracket body 118 will be held at the correct elevation by the tightened nuts on the slider block 122. The jacking block 128 can then be removed and reused. The extra support bolt material above the nuts at the slider block 122 can be removed as well, using conventional cutting techniques.

The lifting assembly 108 and related methodology is not required in all implementations of the foundation support system 100. In certain installations, the foundation 102 is desirably supported and held in place but not moved or lifted, and in such installations the lifting assembly shown and described may be replaced by a support plate, support bracket or other element known in the art to hold the foundation 102 in place without lifting it first. Support plates, support brackets, support caps, and or other support components to hold a foundation in place are available from Pier Tech Systems (www.piertech.com) of Chesterfield, Missouri and other providers, any of which may be utilized in other embodiments of the foundation support system.

As mentioned, it is sometimes necessary to extend the length of a piling by connecting one or more shafts which in combination may provide support that extends deeper into the ground than the shafts individually can otherwise reach. For example, a first helical pier component, referred to as a primary pile, may be driven nearly fully into the ground at the desired location, and a connection component such as an extension pile may then be attached to the end of the primary pile in order to drive the primary pile deeper into the ground while supporting the building foundation at an end of the extension pile. More than one extension pile may be required depending on the lengths of the piles available and/or particular soil conditions.

However, attaching an extension pile to a primary pile to increase the length of the completed piling needed for the job can, be challenging. In conventional foundation support systems, including but not limited to the example shown in FIG. 1, the connection between the primary pile and extension pile is typically made via one or more bolts inserted through fastener holes in the ends of the primary pile and the extension pile. Conventionally, such fastener holes in some cases may be drilled on site as needed, or may be pre-formed in respective couplers that are attached to the primary pile and the extension pile. In either case, because the extension piece may be many feet long and is rather heavy, completing the desired connection to the primary pile with bolts presents a number of complications to an efficient and proper installation of the foundation support system.

As an initial matter, the primary pile and the extension pile must be properly aligned with one another so that the bolts can be inserted, and the bolts must then be tightened while the proper alignment is maintained. If the fastener holes to make the connections are not properly formed or are not properly aligned, difficulties in inserting the bolts are realized, especially so when the fastener holes are threaded and require precise and nearly exact alignment in order to install the bolts. Some trial and error positioning and repositioning of the extension pile is therefore typically required to align the primary pile and the extension pile so that the bolts can be installed, increasing the time and labor costs required to install a piling including the primary pile and the extension pile. When more than one extension pile is needed, such difficulties may be repetitively incurred with each extension pile and will cumulatively increase the time and labor costs required to install the foundation support system. Indeed, in some cases, installers may spend more time installing the bolts than driving the piles into the ground. Also, the difficulty incurred in aligning an extension pile to make the bolted connection to the primary pile can result in a bolted connection being completed, but in a suboptimal manner that can be compromise the integrity of the support system to provide the proper level of support and undesirably affect the support system capacity and reliability.

For example, the fastener holes may elongate or otherwise deform, or the bolts can be damaged, via any attempt to force-fit the bolts when difficulties are encountered or when subsequent torque is applied to drive the piling further into the ground. Any such damage or deformation of fastener holes can reduce the structural strength or capacity of the foundation support system. Likewise, the bolts may not be properly loaded if they are not installed as intended (e.g., if the bolts are installed at unintended angles), which can cause overstress and deformation of the fastener holes when subjected to torsional forces to drive the extension pile and primary pile into the ground. Apart from issues relating to the installation of the bolts themselves with a proper alignment relative to the fastener holes, the mechanical torque transmission between the ends of shafts is transmitted through the bolts as the installation of the system is completed by driving the shafts into the ground to the desired depth. The torsional load carried by the bolts, in turn, may result in sufficiently high mechanical stress so as to deform the fastener holes in the shafts.

Any deformation of the fastener holes, or misalignment of the bolts, may further cause a possibility of the joined ends of the primary pile and the extension pile to move relative to one another. Such relative movement is sometimes referred to herein as "play", and is inherently undesirable and detrimental to the intended support for the foundation that the pilling is supposed to present. Any play in the components during assembly may also introduce additional alignment difficulties and complications in completing a proper installation of the foundation system altogether, and may undesirably increase time and labor costs to complete the installation of the foundation support system.

More recent foundation support systems and components therefor have been developed to reduce the difficulties of interconnecting the foundation support components in the installation of a foundation support system, including but not necessarily limited to a primary pile and an extension pile. For example, patented, self-aligning coupler assemblies are available from Pier Tech Systems (www.piertech.com) of Chesterfield, Missouri that have greatly reduced the difficulties in establishing bolted connections in an installation of a foundation support system. See, e.g., U.S. Pat. Nos. 9,506,214; 9,863,114; 10,294,623; and 10,844,569. The patented Pier Tech couplers include elongated axially extending ribs and elongated axially extending grooves that are mated to one another to establish torque transmitting connections therebetween, with self-alignment of the fastener holes as the couplers are mated to more easily complete the desired bolted connections. The bolts are also mechanically isolated from torque transmission forces in the patented Pier Tech couplers, both for ease of installation and to prevent a problematic deformation of the fastener holes that otherwise may tend to occur. Simpler, easier and more reliable installation of foundation support systems is therefore possible with the patented Pier Tech couplers, but further improvement remains desirable.

Figure 2:
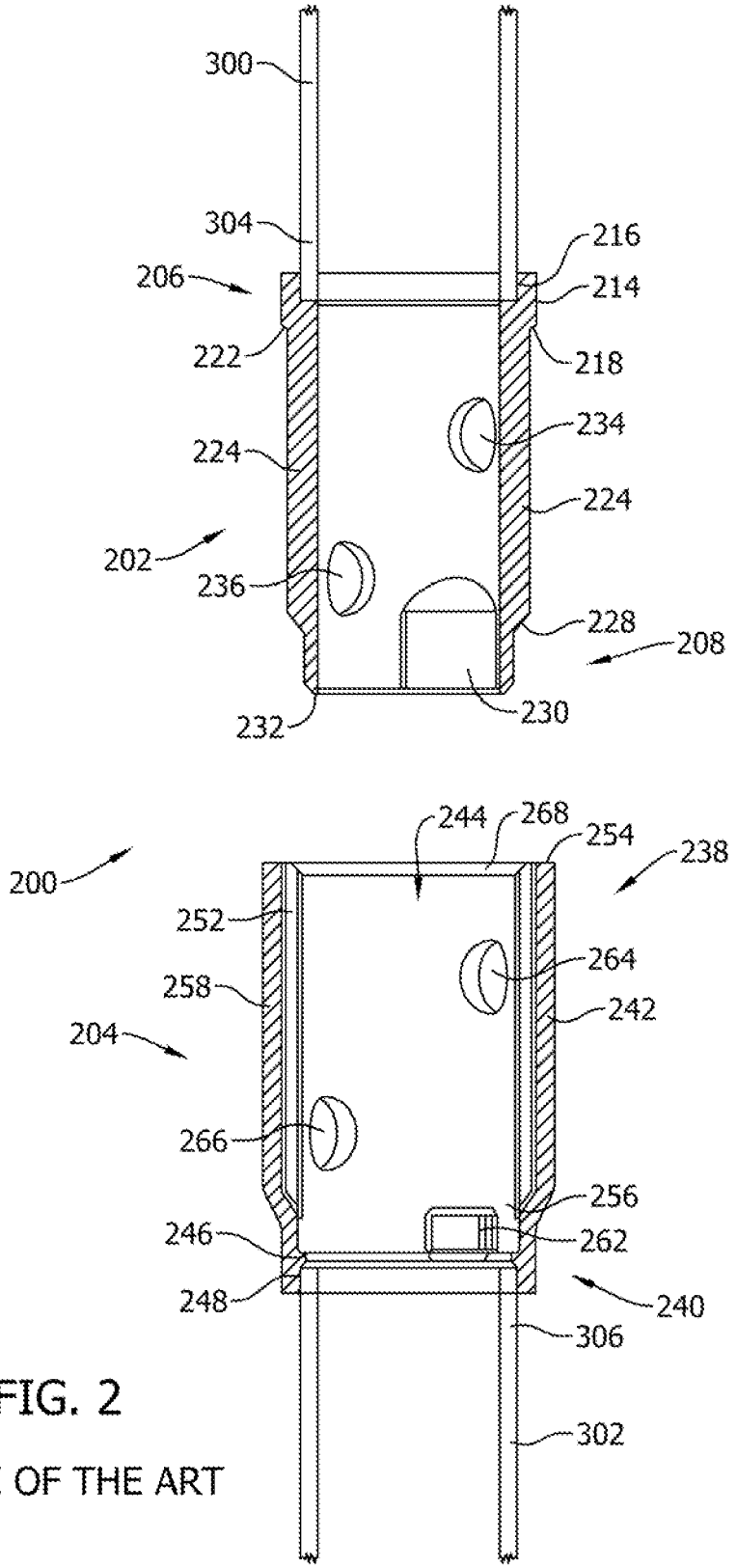
FIG. 2 shows a cross-sectional view of a conventional shaft coupling arrangement for the foundation support system shown in FIG. 1 including an inner coupler and an outer coupler having a non-uniform wall thickness.

FIG. 2 shows a conventional coupler assembly 200 that is described in the aforementioned patents for the patented Pier Tech couplers. FIG. 2 shows the coupler assembly 200 in cross-sectional view wherein the coupler assembly 200 is seen to include an inner coupler 202 attached to a shaft of a first piling 300 and an outer coupler 204 attached to a shaft of a second piling 302. In one embodiment, pilings 300 and 302 each include a length of pipe fabricated from a metal such as steel. The couplers 202, 204 may likewise be integrally formed from a metal material such as steel according to known techniques to include the features shown. The first piling 300 may be of the same dimension in terms of its inner and outer diameter and correspond in cross sectional shape to the second piling 302, to which it is attached. Alternatively stated, the pilings 300, 302 being connected via the coupler assembly 200 are constructed to be the same, albeit with possibly different lengths, although this not necessarily required in all embodiments. The cross-sectional shape of the pilings 300, 302 can be circular, square, hexagonal, or another shape as desired. The pilings 300, 302 can be made to different lengths, however, as the application requires, and the pilings 300, 302 can be hollow or filled with a substance such as concrete, chemical grout, or another known suitable cementitious material or substance familiar to those in the art to enhance the structural strength and capacity of the pilings in use. The pilings 300, 302 may be prefilled with cementitious material in certain contemplated embodiments.

Likewise, in other contemplated embodiments, cementitious material, including but not necessarily limited to grout material familiar to those in the art, may be mixed into the soil around the pilings 300, 302 as they are being driven into the ground, creating a column of cementitious material around the pilings for further structural strength and capacity to support a building foundation. Grout and cementitious material may be pumped through the hollow pilings under pressure as the pilings are advanced into the ground, causing the hollow pilings to fill with grout, some of which is released exterior to the pilings to mix with the soil at the installation site. Openings and the like can be formed in the pilings to direct a flow of cementitious material through the pilings and at selected locations into the surrounding soil.

In the embodiment shown in FIG. 2, the first piling 300 may correspond to an extension piling, such as the extension piling 116 shown in FIG. 1, and the second piling 302 may correspond to a primary piling, such as the primary piling 104 shown in FIG. 1. As noted above, the coupler assembly 200, however, may alternatively be used to connect other shafts of other foundation elements in the foundation support system 100 previously described, or still further may be utilized to connect other structural shaft elements in another application apart from foundation support. In the exemplary embodiment shown, the shaft of the first piling 300 includes a distal end 304, to which is coupled the inner coupler 202, and the shaft of the second piling 302 includes a distal end 306, to which is coupled the outer coupler 204. The distal ends 304 and 306 are positioned adjacent each other such that the inner coupler 202 is configured to be at least partially inserted into the outer coupler 204. As the inner coupler is inserted into the outer coupler, or as the outer coupler is received over the inner coupler, effective torque transmission between the couplers is realized via mating ribs and grooves that respectively project from or are indented in the respective inner and outer side surfaces of the couplers.

As seen in FIG. 2, the patented Pier Tech couplers 202, 204 employ a larger diameter coupler section at the end of each shaft 300, 302 being joined in the installation of the foundation support system. That is, the diameter of the coupler section 202, 204 for each respective shaft 300, 302 is increased relative to the remainder of the shaft so that an increased wall thickness is available in the coupler sections 202, 204 to define the respective outwardly projecting ribs 224 and inwardly extending grooves 252. The increased wall thickness, in turn, provides increased structural strength to transmit torque (via the mated ribs 224 and grooves 252) between the shafts 300, 302 as they are driven into the ground to support a building foundation. From the mechanical perspective, such larger diameter couplers 202, 204 with non-uniform wall thickness functions well, but from the manufacturing perspective it requires some rather complex, intricate shaping of the inner and outer couplers 202, 204 in the fabrication thereof. The additional material (e.g., additional steel) needed to manufacture the coupler sections 202, 204 and fabricating the coupler sections with such a complex shape increases the cost of manufacture of foundation support systems.

Additionally, and as shown in FIG. 2, two coupler sections 202, 204 of different shapes are required to make the desired torque transmitting connections between the shafts 300 and 302, namely the inner coupler 202 and the outer coupler 204 that are mated to one another with the ribs 224 and grooves 252 described in the aforementioned patents. Each of the inner coupler 202 and the outer coupler 204 require a different and relatively complex shape in fabrication that increases cost of fabrication of the couplers from high-strength materials (e.g., steel).

Still further, manufacturing steps of welding separately fabricated couplers 202, 204 to the shafts 300, 302 may be required at further expense in the manufacturing process. Separately fabricated couplers 202, 204 may avoid complications of shaping integrally formed coupler features (e.g., ribs and grooves formed on enlarged diameters at the ends of each shaft), but such cost savings are at least partially offset by the cost of welding the couplers 202, 204 to the shafts 300, 302. Furthermore, welding processes can be subject to imperfections that may cause the welds to weaken, sometimes to the point of failure, either during installation of the foundation support system or afterward. Weakened and failed connections are of course, undesirable, and would require additional time and expense to replace or repair components to install the piling at the proper depth and/or to ensure the desired structural strength of the connections made in the foundation support system.

In other embodiments, the shafts 300, 302, may be integrally formed and built-in design features with enlarged diameters and non-uniform wall thickness at the respective ends thereof to define the rib and groove coupling features as described in the aforementioned patents. For example, the coupler features (e.g., the ribs and grooves on the enlarged diameters) may be forged or swaged on the end of the shafts. Such integral coupler features may avoid the cost and reliability issues of welding processes to attach separately provided couplers as described above, but raise the manufacturing costs of the shafts 300, 302.

Regardless of whether the coupler features are welded, forged or swaged on the ends of the shafts 300, 302 an inventory of different shafts 300, 302 having different coupling features (e.g., inner/outer or male/female connection) is required for the installation of foundation support systems including primary piles and extension piles. To make the torque transmitting connection with the couplers 202, 204 one of the piles is provided with the coupler 202 while the other of the piles is provided with the coupler 204. Manufacturing, stocking and distributing such different primary piles and extension piles respectively including one of the couplers 202 or 204, including primary and extension piles in a number of various different axial length for modular assembly of a foundation support system, further adds cost and complexity from the supply chain perspective. Such costs are further multiplied considering that the diameter of the shafts 300, 302 may vary in the installation of different foundation support systems presenting different loads on the shafts, and therefore shafts with non-uniform wall thickness defining male and female coupling features in various different diameters are needed to fully meet the needs of different installation sites.

The aforementioned Pier Tech Systems patents teach additional embodiments of coupler sections besides than those shown in FIG. 2 employing that likewise employ torque transmitting ribs and grooves for beneficial use in foundation support installations, but the additional embodiments likewise implicate similar issues (e.g., non-uniform wall thickness and complex shaping of the coupler sections) and concerns from the manufacturing and distribution perspective (e.g., relatively high fabrication cost and relatively high component part counts in the supply chain). Simpler and lower cost fabrication with simpler supply chains are accordingly desired to more completely meet the needs of the foundation support system marketplace.

In view of the issues above, simpler and lower cost manufactures of coupled shaft assemblies are accordingly desired to more effectively meet longstanding but unfilled needs in the marketplace, without sacrificing ease of assembly and installation of foundation support assemblies and without compromising foundation support system integrity and reliability.

Inventive embodiments of coupled shaft assemblies are disclosed herein that may be beneficially used in foundation support systems of the type described above or in other types of coupled shaft assemblies presenting similar concerns to those described above and/or which would benefit from the advantages realized by the present invention. Accordingly, while the present invention is described in the context of foundation support system assemblies, such description is for the sake of illustration rather than limitation. Method aspects of fabricating and assembling the coupled shafts will be in part apparent and in part explicit in the following description.

Inventive coupled shaft assemblies in exemplary embodiments of the invention include first and second shafts each having the same diameter and each provided with complementary profiled distal end edges that abut one another to define a non-planar engagement surface, and a coupler sleeve that receives and surrounds each of the profiled distal end edges of the first and second shafts. The first and second shafts may be identically constructed insofar as the mating features defined in the profiled distal end edges are concerned, and the first and second shafts may be fabricated in the same or different axial length for modular assembly in the installation of a foundation support assembly. Advantageously, different shafts having differently configured coupler features are not required in the coupled shaft assembly of the invention, and fabrication costs are therefore reduced. Inventory and distribution issues to provide a range of foundation support systems are likewise simplified and associated costs are further reduced.

Advantageously, the non-planar engagement surfaces in the profiled distal end edges of the first and second shafts directly mate with one another to provide torque transmission capability without increasing the diameter of the first and second shafts, and further without requiring a non-uniform wall thickness at the distal end of the shafts. As such, and for example, the shafts may have a constant or uniform internal and/or external diameter and wall thickness for the entire axial length of the shafts. Specifically, the profiled distal end edges may be shaped or formed without enlarging the diameter of either of the shafts being joined or connected, and without utilizing projecting ribs and surface grooves that require a non-uniform wall thickness per the discussion above. Difficulty and expense associated with fabricating parts with non-uniform wall thickness is accordingly avoided.

In contemplated exemplary embodiments, the profiled distal end edges of the shafts define an undulating, wavy engagement surface at the end edge of each shaft. The wavy engagement surfaces may include complementary rounded or curved, arch-shaped abutment surfaces that facilitate end-to-end engagement of shafts to one another in a guided, self-aligning manner. When the shafts are mated, the profiled distal end edges that abut one another define a series of symmetrical, parabolic torque transmitting engagement surfaces around the circumference of the mated shafts. The parabolic torque transmitting engagement surfaces extend angularly to a longitudinal axis of the shafts being joined in a variable manner that distributes torque transmission unevenly in the mated end edges of the shafts.

The coupler sleeve is advantageously a constant diameter, uniform wall thickness, shaft section having a larger or smaller diameter than the shafts being joined with the profiled distal end edges. The coupler sleeve may snugly receive the profiled distal end edges of each shaft, and may be bolted to each shaft at a distance from the profiled distal end edge of each shaft. The shafts with profiled end edges and the coupler sleeve of the invention are more simply shaped and use relatively less material than more complicated coupler arrangements designed for torque transmission such as that shown in FIG. 2. Accordingly, the shafts and couplers of the invention may be manufactured and provided at relatively low cost while still providing effective torque transmission and ease of assembly, including self-aligning fastener holes to install the bolts. By attaching the coupler sleeve with the first bolt to a first one of the shafts to surround the profiled distal end edge of the first shaft, the second shaft can be inserted into the opposite end of the sleeve coupler in a generally self-guided manner as the profiled distal end edge of the second shaft abuts the profiled distal end edge of the first shaft withing the coupler sleeve.

When the profiled end edges of the first and shafts are fully mated, the bolt holes in the second shaft and in the second coupler will be self-aligned for simple installation of the second bolt to complete the assembly.

Figure 3:
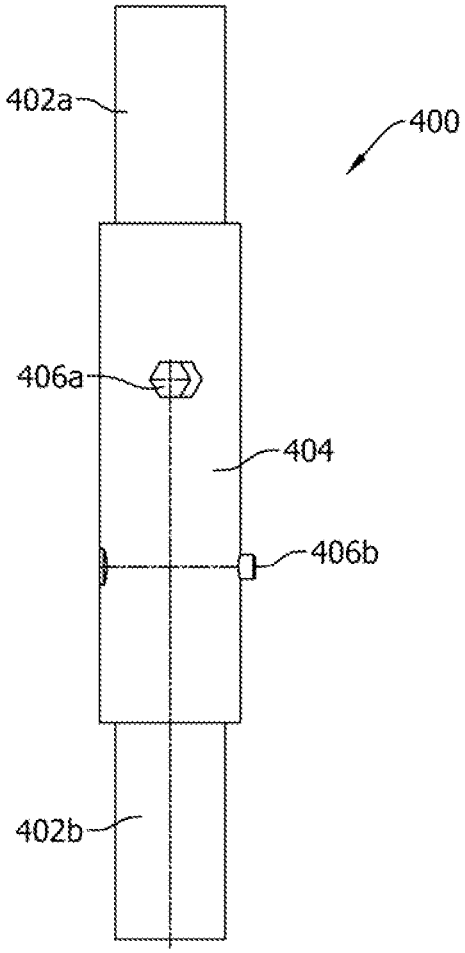
FIG. 3 is a side elevational view of a first exemplary coupled shaft assembly configured in accordance with a first exemplary embodiment of the present invention for rotatable torque transmission between shafts in an installation of a foundation support system such as that shown in FIG. 1.
Figure 4:
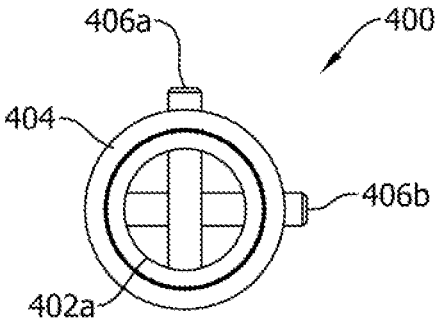
FIG. 4 is a top end view of the coupled shaft assembly shown in FIG. 3.
Figure 5:
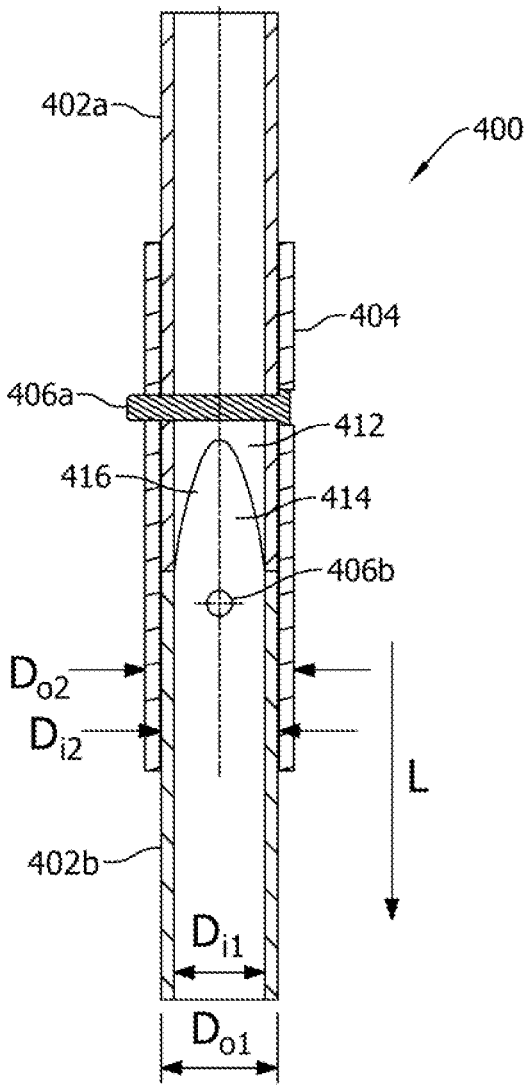
FIG. 5 is a sectional view of the coupled shaft assembly shown in FIG. 3.

Referring now to the Figures, FIGS. 3-5 show an exemplary embodiment of a coupled shaft assembly 400 that may be used in lieu of the coupler assembly 200 in a foundation support system 100 such as that shown in FIG. 1. The coupled shaft assembly 400 includes a first shaft 402*a*, a second shaft 402*b*, and a coupler sleeve 404 that is fastened to the shafts 402*a*, 402*b* with fasteners such as bolts 406*a*, 406*b*.

The shafts 402*a*, 402*b* are fabricated from a high strength material such as steel according to known techniques and methods, although in alternative embodiments materials other than steel may be effectively utilized. Such alternative materials may include metal materials other than steel, non-metal materials or composite materials having, for example, metal and non-metal constituents in combination to provide shafts of sufficient structural strength for an application such as a foundation support system. Provided that the shafts 402*a*, 402*b* have the required structural strength and ability to withstand ambient conditions in use for an adequate lifetime of the end use application of the coupled shaft assembly, a number of different materials may be utilized to fabricate the shafts 402*a*, 402*b* in a wide variety of manufacturing processes that are known and within the purview of those in the art without further explanation.

In the example shown the shafts 402*a*, 402*b* are fabricated as elongated cylindrical or tubular elements having a circular cross section and having the same inner diameter $D_{i1}$ and outer diameter $D_{o1}$ as seen in the end view of FIG. 4 and in the sectional view of FIG. 5. In contemplated embodiments, the inner and outer diameter $D_{i1}$ and $D_{o1}$ are a small fraction of the much larger axial length L of the shafts needed for a foundation support system application. While shafts 402*a*, 402*b* are shown in the illustrated examples with a circular cross-sectional shape, the shafts 402*a*, 402*b* may instead have a non-circular cross-sectional shape, including but not limited to a square cross-sectional shape, a hexagonal cross-sectional shape, or any other cross-sectional shape desired that is capable of meeting the needs of the end use application.

In a contemplated embodiment, the shaft 402*b* may be, for example, a primary pile for a foundation support system, while the shaft 402*a* may be an extension pule for a foundation support system. The primary pile 402*b* may include a helical auger element 110 (FIG. 1) and the primary pile 402*b* and extension pile 402*a* may be fabricated with any axial length desired to realize a combined shaft length to install the pile at the desired depth in the ground. The primary pile 402*b* and the support pile 402*a* may have the same or different axial length L relative to one another.

In another embodiment, each of the shafts 402*a*, 402*b* may be extension piles of a foundation support system. The extension piles may likewise have the same or different axial length relative to one another.

In still another embodiment, the shaft 402*a* may be associated with a foundation support element such as a cap, a plate, or a lift bracket to support a building foundation in combination with the shaft 402*b* which may be either a primary pile or a secondary pile. Likewise, the shaft 402*a* may be associated with a drive tool that applies torque to the shaft 402*b* for driving it into the ground with the connected shaft 402*b* in a foundation support system installation.

The coupler sleeve 404 is fabricated from a high strength material such as steel and in the example shown is fabricated as an elongated cylindrical or tubular element having a circular cross section with an inner diameter $D_{i2}$ slightly larger and about equal to the outer diameter $D_{o1}$ of the shafts 402*a*, 402*b* and an outer diameter $D_{o2}$ that is greater than $D_{i2}$ as seen in the end view of FIG. 4 and in the sectional view of FIG. 5. In another embodiment, the sleeve 404 may have a non-circular cross section, including but not limited to a square cross section or a hexagonal cross section. While the sleeve 404 has a complementary cross-sectional shape (i.e., circular cross-sectional shape in the illustrated examples) to the shafts 402*a*, 402*b*, in another embodiment the sleeve 404 and shafts 402*a*, 402*b* may have non-complementary cross-sectional shapes. For example, the sleeve 404 may have a square or hexagonal outer surface while still snugly receiving the distal ends of the circular shafts 402*a*, 402*b* on the interior of the coupler. Numerous variations are possible in this regard.

The bolts 406*a*, 406*b* respectively extend through the coupler sleeve 404 and through each of the shafts 402*a*, 402*b* as seen in the end view of FIG. 4. In the illustrated example shown in FIGS. 3-5, the first and second bolts 406*a*, 406*b* extend through the coupler sleeve 404 and through a respective one of the respective shafts 402*a* or 402*b*. The first and second bolts 406*a*, 406*b* are oriented such that the axial lengths of the bolts 406*a*, 406*b* are angularly offset from one another, and in the example shown the bolts 406*a*, 406*b* extend in perpendicular orientations to one another that is sometimes referred to as a cross-bolt configuration. It is recognized, however, that the cross-bolt configuration shown and described could be considered optional in some embodiments, and that the bolts 406*a*, 406*b* accordingly could be angularly offset at angles other than 90°.

In contemplated embodiments, the bolts 406*a*, 406*b* are mechanically isolated from torque transmission that is established entirely through torque transmitting engagement surfaces formed in the distal end edges of the mated shafts 402*a*, 402*b* as further described below. In other embodiments, however, the torque transmission may be shared between the mated shafts 402*a*, 402*b* and the bolts 406*a*, 406*b*, and in such a case the perpendicular orientation of the bolts 406*a*, 406*b* advantageously distributes shear stress in the coupler sleeve 404 in an improved manner relative to "in-line" bolts that are conventional to some types of foundation support systems. For purposes of the present description, "in-line bolts" are extended with their axial length aligned and parallel to one another and are therefore not angularly offset. In-line bolts orientations are specifically contrasted with the angularly offset (i.e., non-parallel) cross-bolt orientation of the bolts 406*a*, 406*b* that extend perpendicular to one another as described. It is recognized, however, that in some embodiments in-line bolt orientations may be acceptable and therefore may be utilized in the coupled shaft assembly 400.

FIGS. 6-9 illustrate various views of a first embodiment of a hollow shaft 402 that may be interchangeably used as either of the shafts 402*a* or 402*b* in the coupled shaft assembly 400 shown in FIGS. 3-5.

Figure 6:
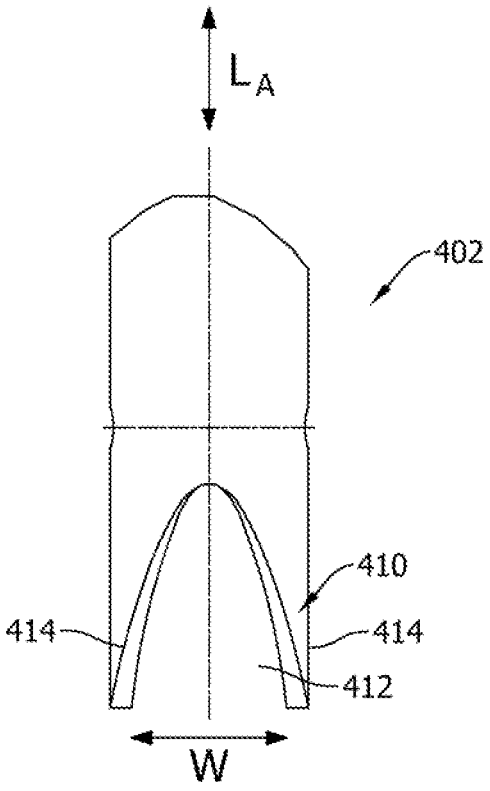
FIG. 6 is an elevational view of a first portion of a first exemplary embodiment of a profiled distal end edge of a shaft for the coupled shaft assembly shown in FIGS. 3 through 5.
Figure 7:
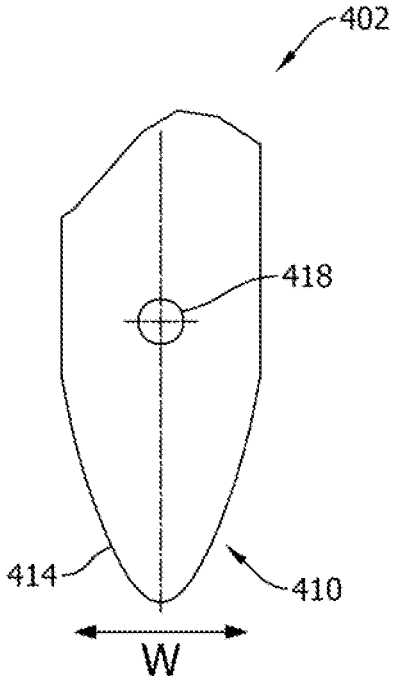
FIG. 7 is an elevational view of a second portion of the first exemplary embodiment of the profiled distal end edge of the shaft shown in FIG. 6.
Figure 8:
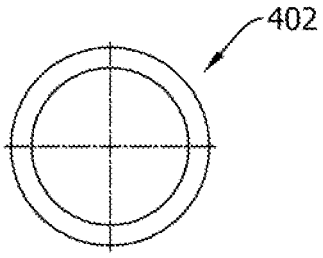
FIG. 8 is an end view of the shaft shown in FIGS. 6 and 7.
Figure 9:
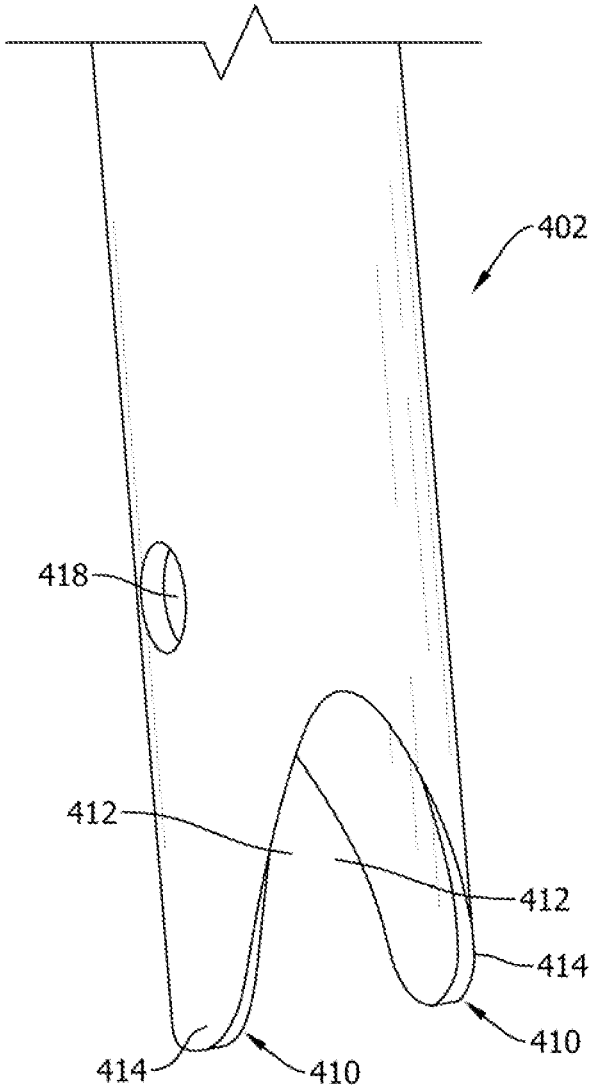
FIG. 9 is a perspective view of the shaft shown in FIGS. 5-8.

The shaft 402 is shown in truncated form in FIGS. 6, 7 and 9 which illustrate only the end portion of the shaft 402. As such, the shaft 402 has a much longer axial length (e.g., many feet in a foundation support example) extending along a longitudinal axis $L_A$ that coincides with a centerline of the shaft 402. FIG. 7 shows the end of the shaft 402 rotated 90° about its longitudinal axis $L_A$ from the position shown in FIG. 6 to illustrate different portions of a profiled distal end edge 410 of the shaft. As shown in FIG. 9, a further rotation 90° of the end of the shaft 402 about its longitudinal axis $L_A$ from the orientation shown in FIG. 6 (i.e., a 180° rotation from that shown in FIG. 6) would reveal that the profiled distal end edge 410 extends in the same manner as shown in FIG. 6, and a further 90° rotation of the end of the shaft 402 about its longitudinal axis $L_A$ (i.e., a 270° from that shown in FIG. 6) would reveal that the profiled distal end edge 410 extends in the same manner as shown in FIG. 7. The shaft 402 is seen in FIG. 6 to have a circular cross section with a uniform inner and outer diameter, and therefore a uniform wall thickness and constant diameter along its entire axial length.

As shown in FIGS. 6, 7 and 9 the distal end edge 410 is profiled and shaped for a direct end-to-end engagement with another shaft 402 in a torque transmitting manner. Such "profiled" distal end edges of the invention are specifically contrasted with "flat" or planar end edges of shafts. FIG. 2, for example shows shafts 300, 302 having flat distal end edges that define abutment surfaces extending perpendicularly to the longitudinal axis of the shafts where they meet the respective inner and outer coupler 202, 204. Each coupler 202, 204, in turn, has flat end edges that extend perpendicular to the longitudinal axis of the shafts being connected. Such flat end edges in the shafts or the couplers are not "profiled" in the context of the invention. Also, the couplers 202, 204 in the example of FIG. 2 operate to prevent a direct end-to-end engagement of the distal end edges of the shafts 300, 302 and instead establish an indirect connection of the shaft distal ends through the couplers 202, 204. In the arrangement of FIG. 2, the couplers 202, 204 extend between and separate the flat distal ends of the shafts 300, 302 such that they do not directly abut or directly engage one another at all.

In the illustrated embodiment, the profiled distal end edge 410 defines an undulating, wavy engagement surface at the distal end edge 410 of the shaft 402. In the view of FIG. 6, the profiled distal end edge 410 defines an arch-shaped cavity 412 while in the view of FIG. 7 the profiled distal end edge 410 defines an arch-shaped extension 414. The arch-shaped cavity 412 and arch-shaped extension 414 are similarly sized and shaped and are therefore complementary to one another, but are inverted as shown in FIGS. 6 and 7 such the arch-shaped cavity 412 is right-side-up while the arch-shaped extension 414 is upside-down on the distal end edge 410. In other words, and as shown in the views of FIGS. 6 and 7, the cavities 412 are shown with concave curvature while the extensions 414 are shown with convex curvature.

The combination of inverted curvatures for the cavities 412 and extensions 414 mean that for the two shafts 402*a*, 402*b* (FIGS. 3 and 5) in the coupler assembly 400 that are each constructed in accordance with the shaft 402, the arch-shaped extensions 414 of the shaft 402*b* can be inserted into the arch-shaped cavities 412 and vice-versa as shown in FIG. 5 by rotating one of the shafts 90° relative to the other until the arch-shaped extensions 414 are aligned with the arch-shaped cavities 412 and the extensions can then be 414 received in the cavities 412 in a rotationally interlocked manner. This creates a series of arch-shaped engagement surfaces 416 (FIG. 5) between the end-edges of the two shafts 402*a*, 402*b* that in turn effectively distributes and transmits torque between the profiled distal end edges 410 of the mated shafts across the number of cavities 412 and extensions 414 provided.

Considering that each shaft 402*a*, 402*b* includes two arch-shaped extensions 414 (centered at the 90° and 270° positions of the shaft 402) and two arch-shaped cavities 412 (centered at the 0° and 180° positions of the shaft 402), the shafts 402*a*, 402 may be rotationally interlocked at four locations via mating of the alternating arch-shaped cavities 412 and arch-shaped extensions 414 around the circumference of the distal end edges of the shafts. The profiled distal end edges of the shafts 402*a*, 402*b* are directly engaged to one another for the entire 360° circumference of the shaft distal end edges in a rotationally interlocking arrangement. Such rotational interlocking and associated torque transmission is beneficially realized without increasing the wall thickness of the shafts 402*a*, 402*b* as best shown in FIG. 5. In other words, the inner and outer sidewall surfaces of the shafts 402*a*, 402*b* are simply smooth and do not include outwardly projecting or inwardly indented torque transmission features such as ribs or grooves that require changes in wall thickness and or introduce a need for complex surface shaping in fabrication processes. By integrating torque transmission features in the profiled distal end edges of the shafts 402*a*, 402*b* in the circumferential direction instead of integrating them in the sidewall surfaces of the shafts in the radial direction as shown in FIG. 2, the shafts 402*a*, 402*b* are simpler to fabricate and therefore may be manufactured at relatively lower cost.

It is recognized, however, that the profiled distal end edges 410 do not necessarily preclude a non-uniform wall thickness in an application where a non-uniform wall thickness is otherwise desirable. As such, in another embodiment a non-uniform wall thickness may still be provided in the shafts 402*a*, 402*b* to provide, for example, additional torque transmitting features such as outwardly projecting ribs and indented grooves, and in such a case a combination of the profiled distal end edges 410 and any ribs and grooves provided may establish torque transmission between shafts in a foundation support assembly, or for any other reason in another application where non-uniform all thickness may define desirable features in the end use application that separately desirable from the profiled distal end edges 410.

As shown in FIGS. 6 and 7, the arch-shaped extensions 414 and the arch-shaped cavities 412 in the shaft 402 have opposed longitudinal sides with curvature that non-linearly decreases a width W of the arch-shaped cavities 412, measured in a direction perpendicular to the longitudinal axis $L_A$ of the shaft 402, in a direction leading away from the furthest extremity of the shaft 402 at its distal end edge. As such, and in the illustrated examples the width W of the cavities 412 is widest at the lower, open bottom end of the shaft (FIG. 6) and gradually reduces in a variable but uneven manner to a smaller width at the opposite closed end of the cavities 412. In contrast, the width W of the extensions 414 is widest at an upper, closed end of the extensions 414 (FIG. 7) and gradually reduces in a variable but uneven manner to a smaller width at the opposite lower end extremity of the extensions 414. When the cavities 412 and extensions 414 are mated (FIG. 5) torque is transmitted between the respective concave and convex curved sides of the cavities 412 and extensions 414. The engagement surface 416 established between them is continuously curved and no portion of the engagement surface 416 extends parallel to the longitudinal axis L A of the shafts in the illustrated example.

The curved engagement surface 416 beneficially distributes torque unevenly along the engagement surface, with the wider portions of the extensions 414 transferring more torque than the narrower portions. This is beneficial because the wider portions of the extensions 414 are structurally stronger than the narrower portions of the extensions 414 and may therefore better withstand torsional forces. Optimized torque transmission is therefore possible along the curved engagement surface to improve shaft reliability and integrity in the foundation support system application.

In the examples illustrated, the arch-shaped cavities 412 and arch-shaped extensions 414 may be defined by parabolic curvature, and in turn may define parabolic torque transmitting engagement surfaces 416 between them when shafts 402 are directly engaged end-to-end. As those in the art would understand, a parabolic curvature refers to a mathematical locus of points that are the same distance from a given point (called the focus) and a given line (called the directrix). The "width" W of the parabola is determined by the distance between the focus and the directrix, which may be strategically selected to provide an optimal torsional force distribution for expected loads.

As those in the art would also understand, a parabolic curve likewise generally corresponds to the graphical plot of the mathematical quadratic function $y=ax^2+b$ where a and b are constants. However defined, the parabolic curvature may be formed, shaped and defined on the distal end edge 410 of the shaft 402 using known fabrication methods and techniques. Such parabolic curvature is believed to be beneficial in producing the desired uneven torque distribution while avoiding discontinuities in the manufacture of the shafts that would either create manufacturing complexities or produce undesirable stress concentration in the shaft in a foundation support system application. It is recognized, however, that for certain loads or other applications a parabolic curvature may not specifically be required and non-parabolic shapes may be adopted. Likewise, discontinuities in curvature may be deemed acceptable in some applications and therefore could be presented in some embodiments, and as such a combination of linear distal end edge surfaces that are not curved could be provided, as well as combinations of linear distal end edge surfaces and curved surfaces to establish end-to-end engagement surfaces with varying degrees of torque transmission distribution and low cost fabrication due to different shaping of the distal end edges.

While the profiled distal end edges of the shaft 402 has two arch-shaped cavities 412 and two arch-shaped extensions 414 numerous variations and adaptations are possible. For example, greater or fewer numbers of cavities 412 and extensions 414 may be provided in the distal end edge. Shafts 402 in another embodiment may include a single (i.e., only one) cavity 412 and a single (i.e., only one) extension 414 located opposite one another (e.g., centered at 180° positions to one another) to provide direct end-to-end engagement with a similar shaft 402 that is rotated 180° relative to the first shaft. Likewise, different shaft configurations could be provided in another embodiment, with one shaft having one or more cavities 412 and the other having one or more extensions 414 that may be directly engaged end-to-end in a torque transmitting relationship. Such cavities 412 and extensions 414 in profiled end edges are likewise possible to establish direct end-to-end torque transmission in shafts having a non-circular cross-section such as a square cross-section, circular cross-section or hexagonal cross-section in other exemplary embodiments.

In the illustrated embodiment each cavity 412 and extension 414 is generally symmetrical, while in other embodiments asymmetrical cavities 412 and extensions 414 may be provided.

As seen in FIGS. 6 and 7, the shaft 402 is further formed with a pair of bolt holes 418 at the 90° positions shown for connection of shaft 402 to the coupler sleeve 404. The bolt holes 418 are generally aligned with the arch-shaped extensions 414 at a distance from the profiled end edge 410 as shown in FIG. 7 and receive one of the bolts 406*a*, 406*b* to fasten the shaft 402 to the coupler sleeve 404. Alternatively, the bolt holes 418 may be provided in locations other than that shown in another embodiment, including but not limited to bolt holes that are aligned with the arch-shaped cavity 412. In still other embodiments bolt holes 418 need not necessarily be aligned with the arch-shaped cavity 412 or the arch-shaped extensions 414, FIGS. 10-11 are various views of the coupler sleeve 404.

Figure 10:
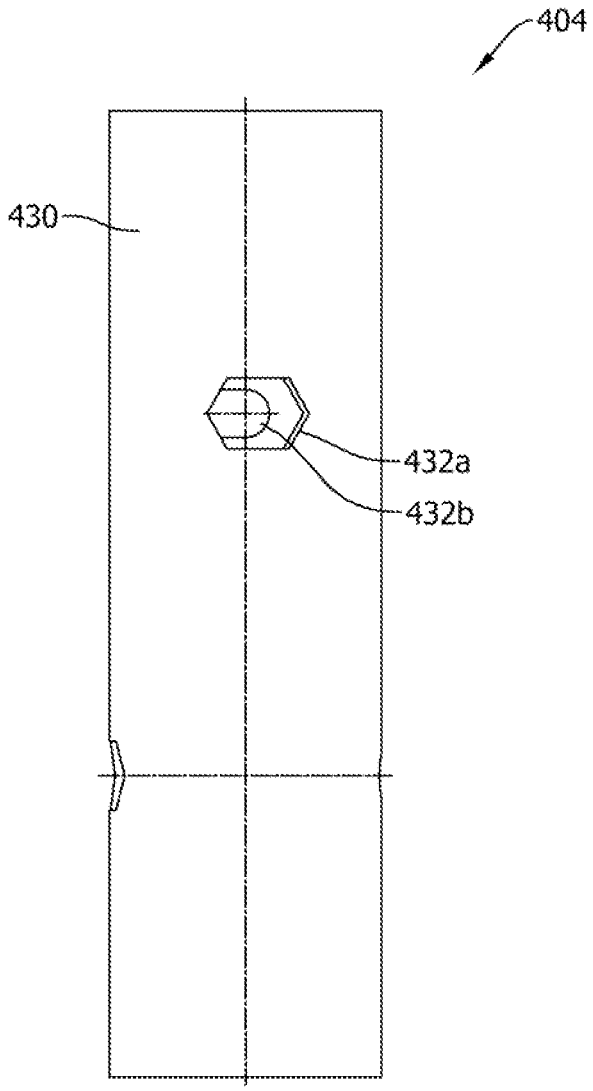
FIG. 10 is a first elevational view of an exemplary embodiment of a coupler sleeve for the coupled shaft assembly shown in FIG. 3.
Figure 11:
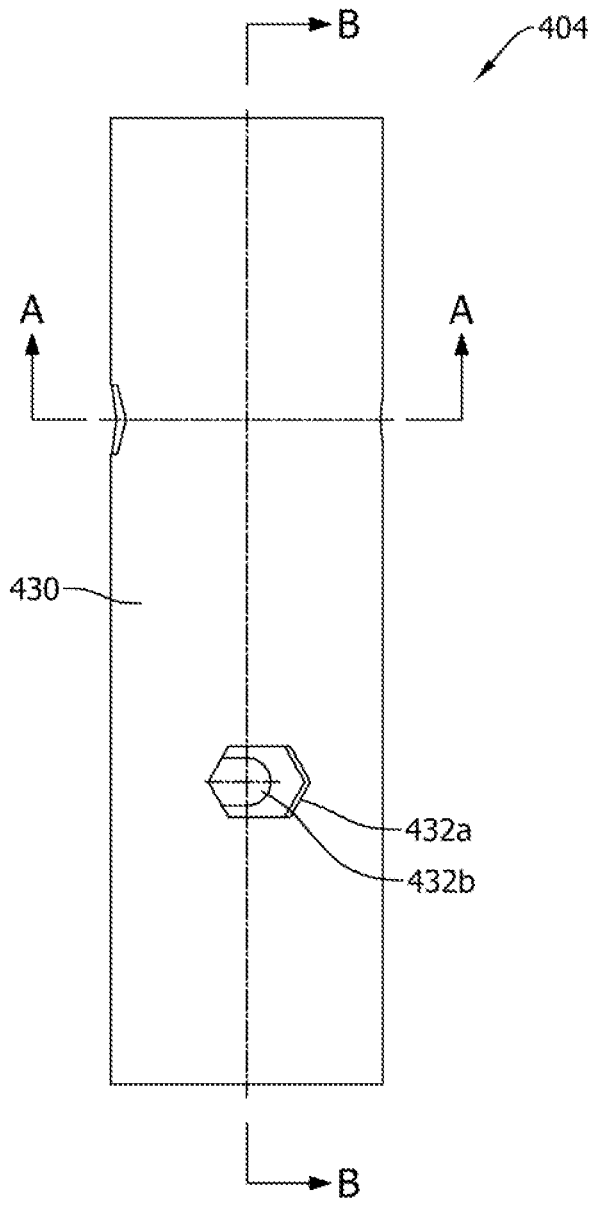
FIG. 11 is a second elevational view of the exemplary coupler sleeve shown in FIG. 10.
Figure 12:
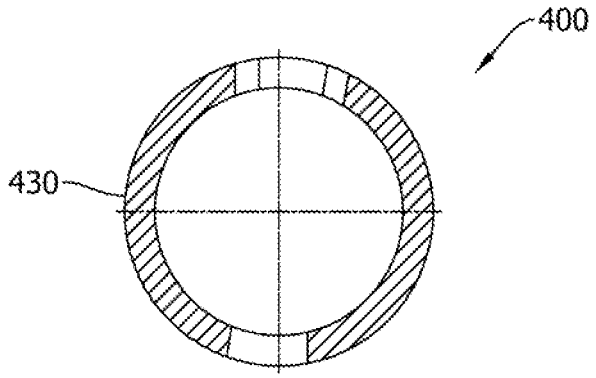
FIG. 12 is a first sectional view of the exemplary coupler sleeve shown in FIGS. 10 and 11 taken along line A-A in FIG. 11.
Figure 13:
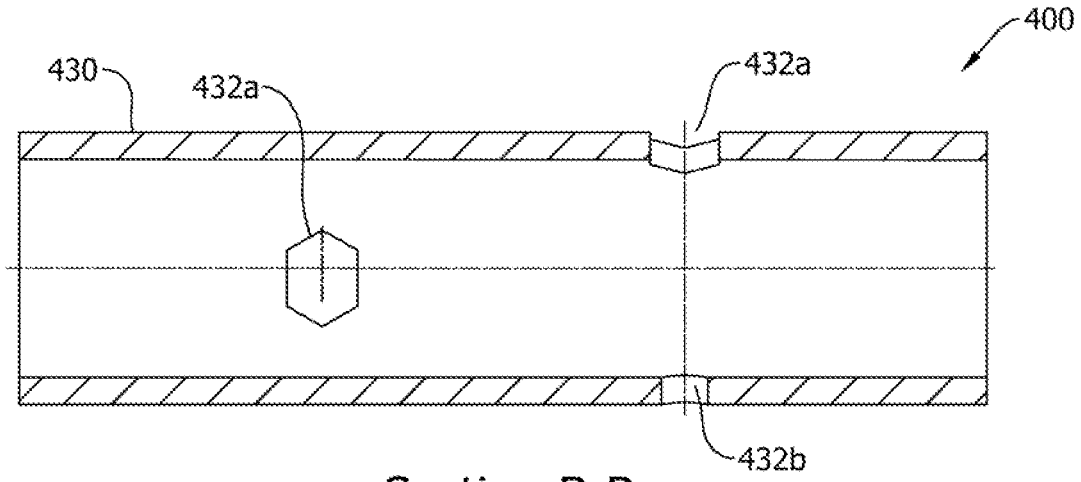
FIG. 13 is a second sectional view of the exemplary coupler sleeve shown in FIGS. 10 and 11 taken along line B-B in FIG. 11.

FIGS. 10 and 11 are elevational views of the coupler sleeve 404 in respective different positions when rotated about the longitudinal axis of the sleeve 404. More specifically, FIG. 11 shows the coupler sleeve rotated 90° about its longitudinal axis from the view shown in FIG. 10. FIGS. 12 and 13 are sectional views of the coupler sleeve.

As shown in the Figures, the coupler sleeve 404 in the illustrated example is fabricated as a hollow tubular element 430 with a circular cross-section along its entire axial length. The axial length of the sleeve 404 is much less than the axial length of the shafts 402*a*, 402*b* being joined and connected A first pair of bolt holes 432*a*, 432*b* is formed in the sleeve 404 at a first location as shown in FIG. 10 for receiving the first bolt 406*a* (FIG. 3) and a second pair of bolt holes 432*a*, 432*b* is formed at a second location as shown in FIG. 11 for receiving the second bolt 406*b* to fasten the shafts 402*a*, 402*b* to one another with the their profiled distal end edges 410 directly engaged to one another. The first and second pairs of bolt holes 432*a*, 432*b* are angularly offset from one another, and axially spaced from one another to realize the cross-bolt configuration described above, while in another embodiment the pairs of bolt holes 432*a*, 432*b* may be arranged for in-line bolt orientations or any other arrangement desired.

Further, in each pair of bolt holes 432*a*, 432*b* differently shaped holes are provided. In the illustrated example, a first opening 432*a* has polygonal edges that may receive complementary polygonal sides edges of a bolt head and a second opening 432*b* has an oval shaped opening to receive an end of the bolt shaft opposite the head. As such, each of the openings 432*a*, 432*b* are larger than needed to insert the bolts through the coupler sleeve 404 and through the bolt holes 418 in the shafts 402*a*, 402*b*. The larger bolt holes 432*a*, 434*b* simplify the assembly and fastening of the sleeve 404 to the shafts 402*a*, 402*b*.

In a contemplated foundation support system assembly, the shaft 402*b* may be driven into the ground (either as a primary pile or as an extension pile) at a desired location in the installation of the foundation support system 100. The sleeve 404 may be snugly extended over the distal end of the shaft 402*b* and the lower bolt holes 432*a*, 432*b* may be aligned with the bolts holes 418 in the shaft 402*b*. The bolt 406*b* may then be inserted through the aligned bolt holes to extend through the sleeve 404 and the shaft 402*b* for fastening the coupler sleeve 404 to the shaft 402*b* with a nut.

With the coupler sleeve 404 in place on the lower shaft 402*b*, the shaft 402*a* may then be inserted into the upper end of the sleeve 404 and if needed the shaft may be rotated to align and mate the arch-shaped cavities 412 and arch-shaped extensions 414 in each shaft 402*a* and 402*b* to establish the direct end-to-end torque transmission between the shafts 402*a* and 402*b*. The interlock of the arch-shaped cavities 412 and arch-shaped extensions 414 is assisted by gravitational forces and the curved engagement surfaces 416 in a self-guided manner. Precise alignment of the arch-shaped cavities 412 and arch-shaped extensions 414 by the installer/assembler is not necessary in order to establish the rotational interlock engagement of the shafts.

Once the direct end-to-end engagement surface 416 is established between the shafts 402*b*, 402*a* is established in the self-guiding or self-aligning manner described above, the upper bolt holes 432*a*, 432*b* are automatically aligned with the bolt holes 418 in the shaft 402*a* for easy insertion of the bolt 406*a* (FIG. 5) to complete the connection of the shaft 402*a* and the coupler sleeve with a nut. The bolted sleeve and shaft connections ensure that the rotational interlocking of the profiled end edges is maintained and ensure that the shafts 402*a*, 402*b* cannot become inadvertently disengaged during installation or cannot disengage if subjected to tensile forces in use, either of which could compromise the integrity of the foundation support system 100. The bolts 406*a*, 406*b* are, however, mechanically isolated from torque transmission in the assembly 400 by virtue of the directly engaged, torque transmitting profiled distal end edges 410 as the connected shafts 402*b*. 402*a* are driven into the ground to complete the installation of a foundation support system.

Additional sleeves 404 and shafts can be attached to previously connected shafts in a similar manner to interconnect any number of primary piles and extension piles in a foundation support system, or to connect other foundation support system components (e.g., cap, lift plate or lift bracket) to an end of a pile to complete a foundation support system.

Shafts 402*a*, 402*b* may be filled with cementitious material prior to or during their installation into the ground for further benefit in the foundation support system 100 as desired.

Figure 14:
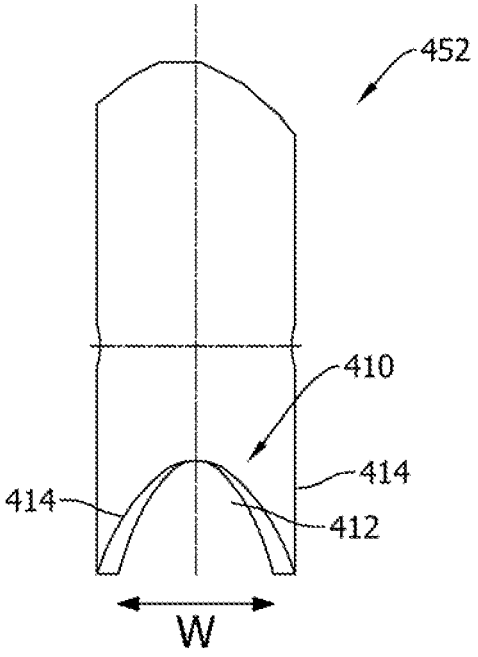
FIG. 14 is an elevational view of a first portion of an second exemplary embodiment of a profiled distal end edge of a shaft for the coupled shaft assembly shown in FIGS. 3 through 5.
Figure 15:
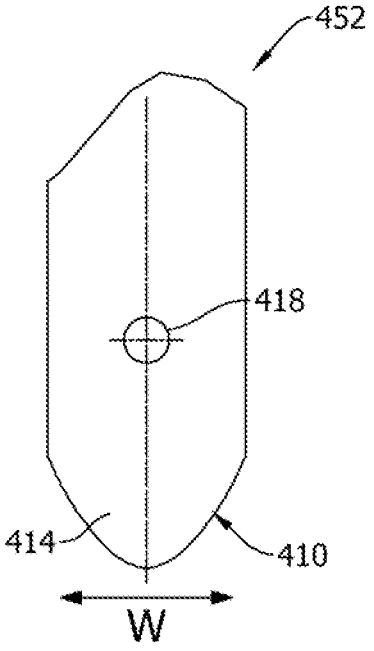
FIG. 15 is an elevational view of a second portion of the exemplary profiled distal end edge of the shaft shown in FIG. 14.
Figure 16:
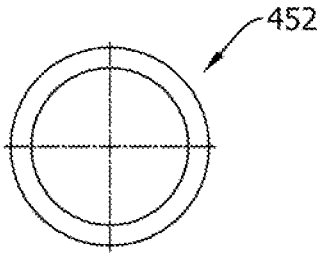
FIG. 16 is an end view of the shaft shown in FIGS. 14 and 15.

FIGS. 14 through 16 are respective views of an exemplary second embodiment of shaft 452 that is similar to the shaft 402 but has a differently shaped parabolic curvature of the arch-shaped cavities 412 and differently shaped arch-shaped extensions in the distal end edges 410. The shaft 452 may be used in lieu of the shaft 402 in a foundation support system 100 or in another end use.

Compared to the curvature of the arch-shaped cavities 412 and arch-shaped extensions 414 in the shaft 402, the curvature of the arch-shaped cavities 412 and arch-shaped extensions 414 in the shaft 452 is shallower. In other words, the curvature of the arch-shaped cavities 412 and arch-shaped extensions 414 in the shaft 452 does not extend as far along the longitudinal axis of the shaft 502. Such shallower curvature may be appropriate in the coupled shaft assembly 400 for smaller diameter shafts and/or in shafts carrying smaller loads.

Direct end-to-end end torque transmission between shafts as described above may be more or less universally employed across shafts of different cross sections and different diameters, and even widely varying shaft diameters, in a variety of different foundation support systems or for a variety of other applications to which the benefits of the assembly 400 may accrue. The hollow shafts described may be filled with cementitious material for additional benefit in foundation support system.

The coupled shaft assemblies may be particularly desirable as they avoid the need for more intricately shaped coupler features fabricated with non-uniform wall thickness such as those shown in FIG. 2, but it is recognized that the direct distal end edge torque transmission between the shafts may be applied in combination with coupler elements that include non-uniform wall thickness that may be desirable for the end application. That is, in additional and/or alternative embodiments coupler features of more complex shape with varying wall thickness above may be utilized in addition to the direct end-to-end engagement of the shafts to realize desired benefits (e.g., distribution of torque across a greater number of features and locations in the coupled shaft assemblies).

In certain contemplated embodiments, profiled end edges can also be formed in enlarged diameter coupler sections to establish direct, end-to-end torque transmitting engagement between shafts. In such a case, enlarged diameter coupler sections (whether separately provided and attached to the shafts or integrally formed in the shafts) may still be used in a foundation support system or other application for the coupled shaft assembly, albeit at greater manufacturing expense. A strategic use of enlarged diameter coupler sections may realize material savings in some embodiments wherein a reduction of the shaft diameter apart from the coupler sections is possible while still accommodating the desired structural loads in the foundation support system or other mechanical end use of the coupled shaft assembly.

Figure 17:
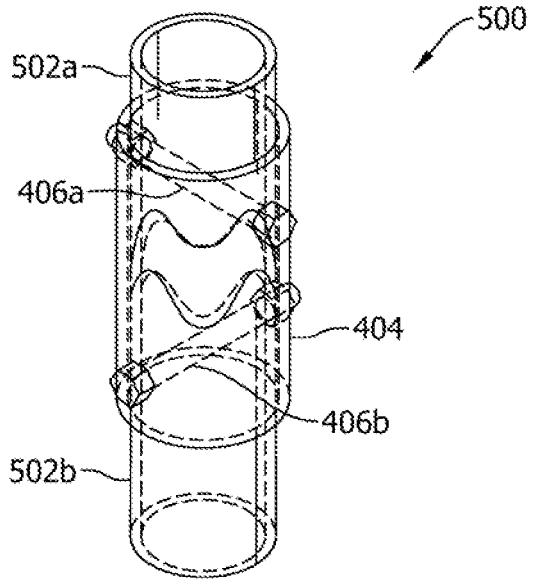
FIG. 17 is a perspective view of a second exemplary coupled shaft assembly configured for rotatable torque transmission between shafts in an installation of a foundation support system such as that shown in FIG. 1.
Figure 18:
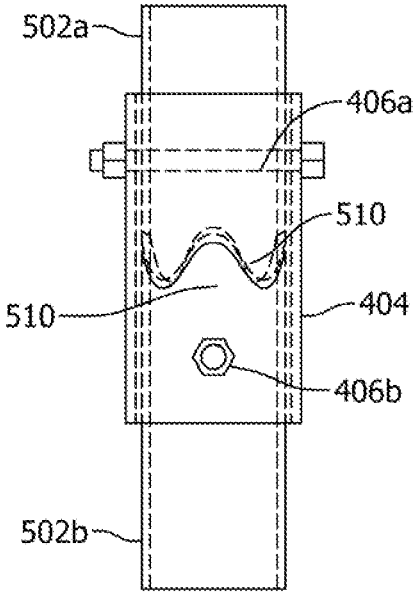
FIG. 18 is a first side elevational view of the exemplary coupled shaft assembly shown in FIG. 17.
Figure 19:
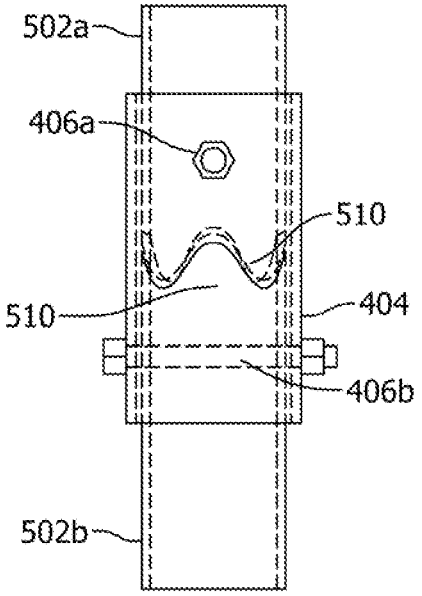
FIG. 19 is a second side elevational view of the exemplary coupled shaft assembly shown in FIG. 17.

FIGS. 17-19 are respective views of a coupled shaft assembly 500 configured in accordance with a second exemplary embodiment of the present invention. FIG. 17 is a perspective view of the coupled shaft assembly 500, and FIGS. 18 and 19 are respective side elevational views of the coupled shaft assembly 500 wherein the coupled shaft assembly 500 is rotated 90° about its longitudinal axis. The shaft assembly 500 may be utilized in the foundation support assembly 100 in lieu of the foundation support assembly 400 described above.

As shown in the Figures the coupled shaft assembly 500 includes shafts 502*a*, 502*b* that are similar to the shafts 402*a*, 402*b* described above but have different profiled distal end edges that directly mate and engage with one another in the coupler sleeve 404 to realize a torque transmitting connection. Specifically, and as shown in FIGS. 17-19, the shafts 502*a*, 502*b* include complementary profiled distal end edges 510 having additional spaced apart arch-shaped extensions and three spaced apart arch-shaped cavities in an alternating sequence that in combination provide a direct, end-to-end surface engagement and torque transmission in the installation of a foundation support system such as that described above. Compared to the shafts 402*a* and 402*b* described above that include two spaced apart arch-shaped extensions and two spaced apart arch-shaped cavities in an alternating sequence in their profiled distal end edges 410, the profiled distal end edges 510 of the shafts 502*a*, 502*b* including more than two arch-shaped extensions and cavities distribute torque across a greater number of engaged extensions and cavities. For example, the profiled distal end edges 510 of the shafts 502*a*, 502*b* may include three or four engaged extension and cavities. As such, the distribution of force and mechanical stress across a greater number of extensions and cavities in the coupled shaft assembly 500 may be preferred in some installations. In further embodiments, more than three or four extensions and cavities may be provided to further vary the force and stress distributions in the assembly 500.

Except as noted above, the benefits and advantages of the coupled shaft assembly 500 and the coupled shaft assembly 400 are otherwise similar.

Figure 20:
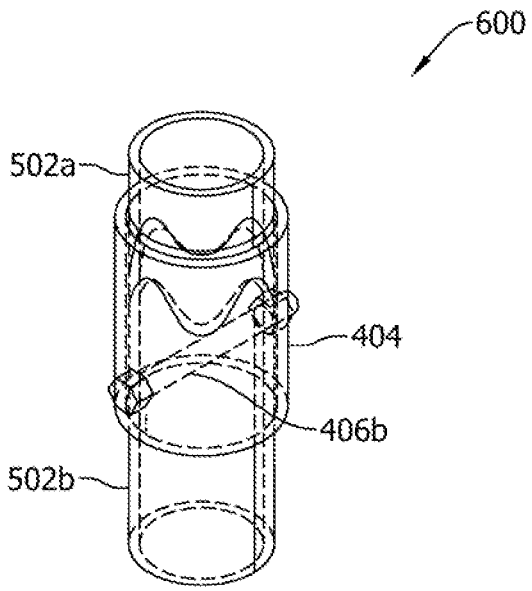
FIG. 20 is a perspective view of a third exemplary embodiment of a coupled shaft assembly configured for rotatable torque transmission between shafts in an installation of a foundation support system such as that shown in FIG. 1.
Figure 21:
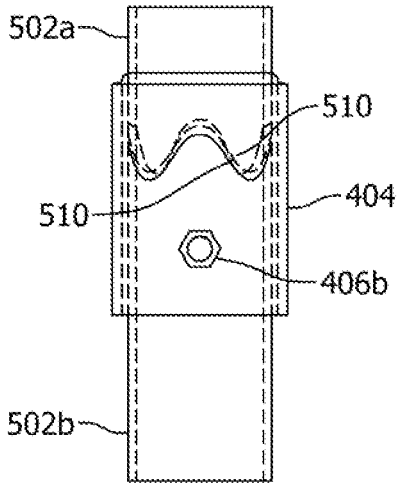
FIG. 21 is a first side elevational view of the exemplary coupled shaft assembly shown in FIG. 20.
Figure 22:
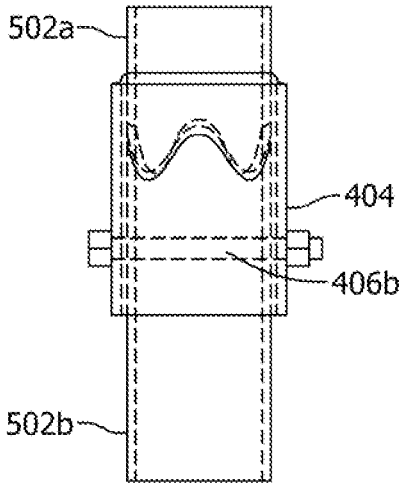
FIG. 22 is a second side elevational view of the exemplary coupled shaft assembly shown in FIG. 20.

FIGS. 20-22 are respective views of a coupled shaft assembly 600 configured in accordance with a third exemplary embodiment of the present invention. FIG. 20 is a perspective view of the coupled shaft assembly 600, and FIGS. 21 and 22 are respective side elevational views of the coupled shaft assembly 600 wherein the coupled shaft assembly 600 is rotated 90° about its longitudinal axis. The shaft assembly 600 may be utilized in the foundation support assembly 100 in lieu of the foundation support assembly 400 or 500 described above.

The coupled shaft assembly 600 is similar to the shaft assembly 500 but includes a single (i.e., only one) fastener 406*b* connected to the shaft 502*b* to the coupler sleeve 404. The fastener 406*a* (FIGS. 17-19) is not utilized in the coupled shaft assembly 600. The fastener 406*a* is not required in the absence of an uplift force that would otherwise tend to separate the shaft 502*a* from the coupler sleeve 404 and the shaft 502*b*. Therefore, in foundation support assemblies wherein uplift is not of concern, the coupled shaft assembly 600 may be preferred as a simpler installation that requires only one bolted connection instead of two as in the coupled shaft assemblies described above. For the same reason, the coupled shaft assembly 400 or 500 described above may likewise be provided with the fastener 406*b* but not the fastener 406*a* in certain embodiments.

Except as noted above, the benefits and advantages of the coupled shaft assembly 600 and the coupled shaft assembly 400 and 500 are otherwise similar.

Figure 23:
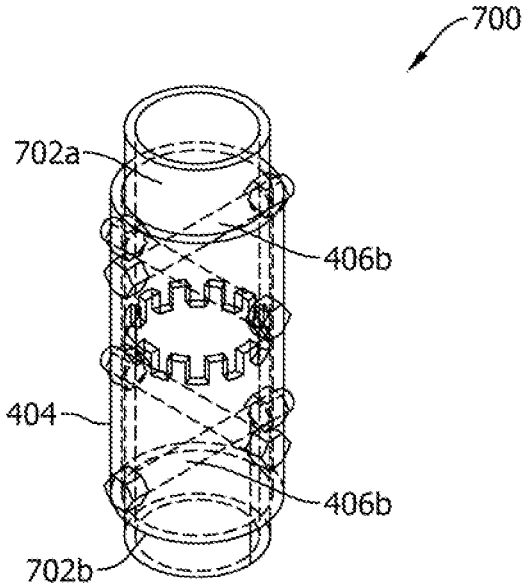
FIG. 23 is a perspective view of a fourth exemplary embodiment of a coupled shaft assembly configured for rotatable torque transmission between shafts in a foundation support system such as that shown in FIG. 1.
Figure 24:
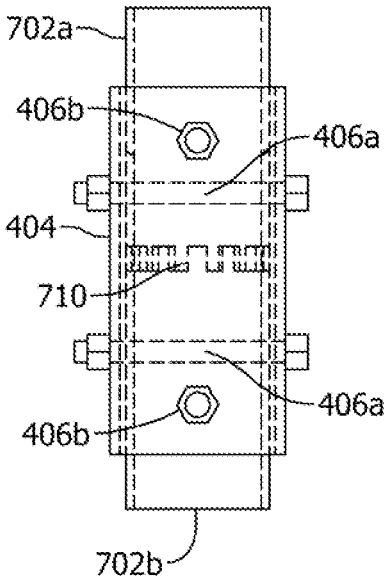
FIG. 24 is a first side elevational view of the exemplary coupled shaft assembly shown in FIG. 23.
Figure 25:
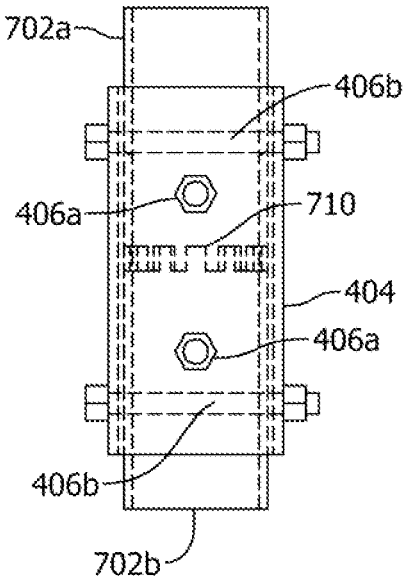
FIG. 25 a second side elevational view of the exemplary coupled shaft assembly shown in FIG. 23.

FIGS. 23-25 are respective views of a coupled shaft assembly 700 configured in accordance with a fourth exemplary embodiment of the present invention. FIG. 23 is a perspective view of the coupled shaft assembly 700, and FIGS. 24 and 25 are respective side elevational views of the coupled shaft assembly 700 wherein the coupled shaft assembly 700 is rotated 90° about its longitudinal axis. The shaft assembly 700 may be utilized in the foundation support assembly 100 in lieu of the foundation support assembly 400, 500 or 600 described above.

As shown in the Figures the coupled shaft assembly 700 includes shafts 702*a*, 702*b* that are similar to the shafts 402*a*, 402*b* described above but have different profiled distal end edges that mate with one another in the coupler sleeve 404. Specifically, and as shown in FIGS. 23-25, the shafts 702*a*, 702*b* include complementary profiled distal end edges 710 having a series of alternating rectangular-shaped extensions and rectangular-shaped cavities that in combination provide a direct, end-to-end surface engagement and torque transmission along linear edge surfaces in the installation of a foundation support system such as that described above. A distribution of force and mechanical stress across a number of rectangular-shaped extensions and cavities in the coupled shaft assembly 700 may be preferred in some installations, and the shafts 702*a*, 702*b* with the profiled distal end edges 710 may be easier to fabricate than the wavy profiled end edges described above. Stress concentration in portions of the rectangular opening and extensions may be acceptable in certain installations.

Additionally, the coupled shaft assembly 700 includes first second pairs of fasteners 406*a*, 406*b* in a cross-bolt arrangement to establish respective connections between the shafts 702*a*, 702*b* and the coupler sleeve 404. Such first and second pairs of fasteners 406*a*, 406*b* may likewise be utilized in, for example, the coupled shaft assembly 400, 500 or 600 as desired. Such cross-bolt connections and rectangular extensions and cavities in the profiled end edges 710 of the shafts 702, 704 may be particularly advantageous for higher load capacity required by the foundation support system. As described above, in other embodiments of the coupled shaft assembly 700, bolted connections may be made to only one of the two shafts 702*a* or 702*b* if desired.

Except as noted above, the benefits and advantages of the coupled shaft assembly 700 and the coupled shaft assembly 400 are otherwise similar.

Figure 26:
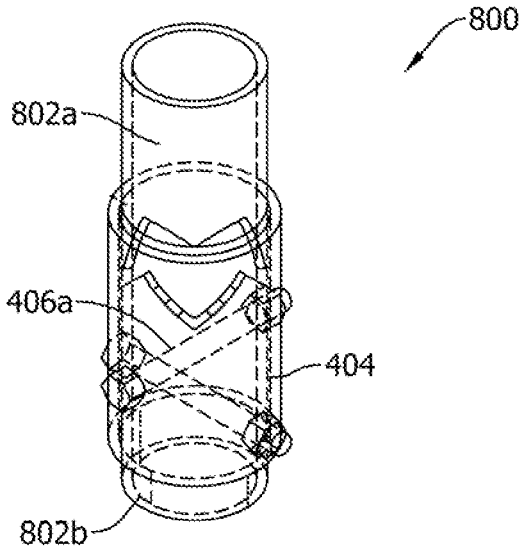
FIG. 26 is a perspective view of a fourth exempla embodiment of a coupled shaft assembly configured for rotatable torque transmission between shafts in a foundation support system such as that shown in FIG. 1.
Figure 27:
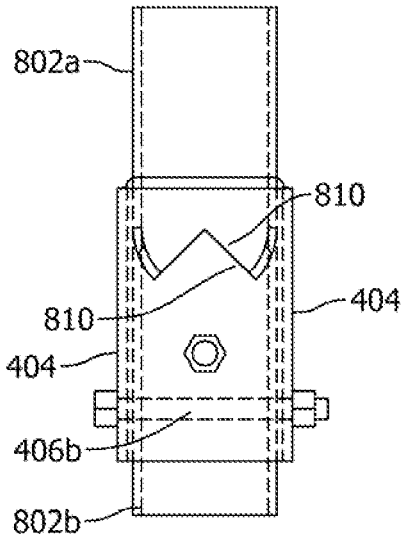
FIG. 27 is a first side elevational view of the exemplary coupled shaft assembly shown in FIG. 26.
Figure 28:
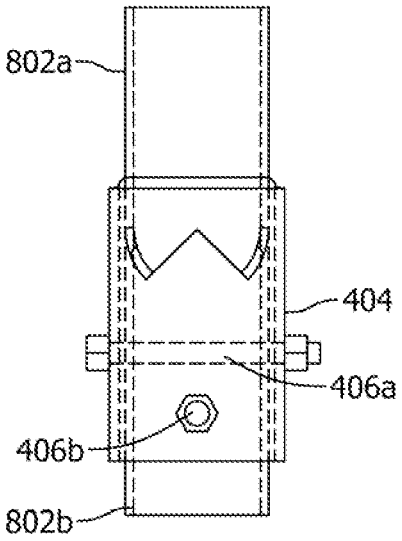
FIG. 28 is a second side elevational view of the exemplary coupled shaft assembly shown in FIG. 26.

FIGS. 26-28 are respective views of a coupled shaft assembly 800 configured in accordance with a fifth exemplary embodiment of the present invention. FIG. 26 is a perspective view of the coupled shaft assembly 800, and FIGS. 27 and 28 are respective side elevational views of the coupled shaft assembly 800 wherein the coupled shaft assembly 800 is rotated 90° about its longitudinal axis. The shaft assembly 800 may be utilized in the foundation support assembly 100 in lieu of the foundation support assembly 400, 500, 600 or 700 described above.

As shown in the Figures the coupled shaft assembly 800 includes shafts 802*a*, 802*b* that are similar to the shafts 402*a*, 402*b* described above but have different profiled distal end edges that mate with one another in the coupler sleeve 404. Specifically, and as shown in FIGS. 26-28, the shafts 802*a*, 802*b* include complementary profiled distal end edges 810 having a series of triangular-shaped extensions and triangular-shaped cavities that in combination provide a direct, end-to-end surface engagement and torque transmission along linear edge surfaces in the installation of a foundation support system such as that described above. A distribution of force and mechanical stress across a number of triangular-shaped extensions and cavities in the coupled shaft assembly 800 may be preferred in some installations, and the shafts 802*a*, 802*b* with the profiled distal end edges 810 may be easier to fabricate than the wavy profiled end edges described above. Stress concentration in portions of the triangular opening and extensions may be acceptable in certain installations.

Additionally, the coupled shaft assembly 800 includes only a first and second pair of fasteners 406*a*, 406*b* in a cross-bolt arrangement to establish a connection between the shafts 802*b* and the coupler sleeve 404. Compared to, for example, the coupled shaft assembly 700, a second pair of fasteners 406*a*, 406*b* is not provided to connect the shaft 802*a* to the coupler sleeve 404. In other embodiments, however, a second pair of fasteners could be utilized when desired to connect the shaft 802*a*

Except as noted above, the benefits and advantages of the coupled shaft assembly 800 and the coupled shaft assembly 400 are otherwise similar.

The foregoing examples of coupled shaft assemblies include an external coupler sleeve 404 extending around an outer circumference of distal ends of the shafts. Alternative embodiments may include, however, an internal coupler sleeve 404 extending interior to the distal ends of the shafts while still realizing the benefits of establishing the direct, end-to-end torque transmission via the profiled distal end edges of the shafts described.

While numerous examples of profiled distal end edges are now described, still further geometries of extensions and cavities in profiled distal end edges are possible and may be utilized in further embodiments with similar effect and advantages. The benefits and advantages of the inventive subject matter are now believed to be apparent from the exemplary embodiments disclosed.

An embodiment of a foundation support system has been disclosed. The foundation support system includes a coupled shaft assembly including a first hollow support shaft formed with a first axial length and a first profiled distal end edge, and a second hollow support shaft formed with a second axial length and a second profiled distal end edge. When the first and second profiled distal end edges are directly abutted and engaged to one another, a torque transmitting connection is established between the first hollow support shaft and the second hollow support shaft in order to drive the coupled shaft assembly to a desired depth in an installation of the foundation support system.

Optionally, the first and second profiled distal end edges may be identically shaped to one another. The first and second profiled distal end edges may also be configured to be self-aligning with one another via relative rotation of the first hollow support shaft with respect to the second hollow support shaft. The first and second profiled distal end edges may provide torque transmission capability without an increased diameter of either of the first and second hollow support shafts. The first and second profiled distal end edges of the first and second hollow shafts may extend in a circumferential direction instead of in a radial direction in a sidewall surface of the first or second hollow support shaft. The first and second hollow support shafts may be respectively formed with an axial length including the first and second profiled distal end edges, and the first and second hollow support shafts may be formed with a uniform wall thickness along an entirety of the axial length. The first and second hollow support shaft may have one of a circular cross-sectional shape, a square cross-sectional shape or a hexagonal cross-sectional shape.

As further options, each of the first and second profiled distal end edges may define an undulating engagement surface. Each undulating engagement surface may include alternating arch-shaped cavities and arch-shaped extensions. The arch-shaped extensions and arch-shaped cavities may be defined by parabolic curvature. Each of the first and second profiled distal end edges may likewise define alternating rectangular-shaped cavities and rectangular-shaped extensions or alternating triangular-shaped cavities and triangular-shaped extensions.

The coupled shaft assembly may also optionally include a sleeve and at least one bolt attaching the sleeve to the first hollow support shaft. The sleeve may surround a circumference of the directly abutted and engaged first and second profiled distal end edges. The first hollow support shaft may include a pair of fastener holes and the sleeve may include a second pair of fastener holes, with the first and second pair of fastener holes becoming self-aligned when the first and second profiled distal ends are directly abutted and engaged. The at least one bolt may be mechanically isolated from torque transmission in the coupled shaft assembly. The at least one bolt may include a first bolt and a second bolt attaching the sleeve to the second hollow support shaft. The first bolt and the second bolt may extend in a cross-bolt orientation to one another. The sleeve may have one of a circular cross-sectional shape, a square cross-sectional shape or a hexagonal cross-sectional shape. The sleeve may be formed with an axial length, and the sleeve may further be formed with a uniform wall thickness along an entirety of the axial length. The sleeve may be formed with a first pair of fastener openings to receive a first fastener extended through the first pair of fastener openings, the first pair of fastener openings including a first opening having a first shape and a second opening having a different shape than the first shape. The foundation support system may optionally further include a cap, a plate, or a lift bracket to support a building foundation in combination with the coupled shaft assembly. The foundation support system may be provided in combination with a grout or cementitious material to enhance a structural strength and capacity of the coupled shaft assembly in the installed foundation support system.

The first and second hollow support shafts may optionally be steel shafts. One of the first and second hollow support shafts may include a helical auger.

Another embodiment of a foundation support system has been disclosed. The foundation support system includes a coupled shaft assembly which may include a first hollow support shaft, a second hollow support shaft and a hollow sleeve. The first hollow support shaft may have a first axial length, a first profiled distal end edge, and a uniform sidewall thickness along an entirety of the first axial length including the first profiled distal end edge. The second hollow support shaft may have a second axial length, a second profiled distal end edge, and a uniform sidewall thickness along an entirety of the second axial length including the second profiled distal end edge. The hollow sleeve may have a third axial length and a uniform sidewall thickness along an entirety of the third axial length. The sleeve is configured to surround the first and second profiled distal end edges when directly abutted and maintain a torque transmitting connection therebetween in order to secure the coupled shaft assembly at a desired depth in an installation of the foundation support system.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A foundation support system comprising:

a coupled shaft assembly comprising:

a first hollow support shaft formed with a first axial length and a first profiled distal end edge;

a second hollow support shaft formed with a second axial length and a second profiled distal end edge;

a hollow sleeve that is slidably movable relative to the first hollow support shaft after the first hollow support shaft is driven to a first depth in an installation of the foundation support system; and a first fastener attaching the hollow sleeve to the first hollow support shaft and maintaining the first profiled distal end edge in a fixed position relative to the sleeve;

wherein when the second profiled distal end edge is slidably engaged to the sleeve and directly abutted and engaged to the first profiled distal end edge, a torque transmitting connection is established between the first hollow support shaft and the second hollow support shaft in order to drive the coupled shaft assembly to a second depth in the installation of the foundation support system; and wherein the first fastener is mechanically isolated from torque transmission in the coupled shaft assembly.

2. The foundation support system of claim 1, wherein the first and second profiled distal end edges are identically shaped to one another.

3. The foundation support system of claim 1, wherein the first and second profiled distal end edges are configured to be self-aligning with one another via relative rotation of the second hollow support shaft with respect to the hollow sleeve.

4. The foundation support system of claim 1, wherein the first and second profiled distal end edges provide torque transmission capability without an increased diameter of either of the first and second hollow support shafts.

5. The foundation support system of claim 1, wherein the first and second profiled distal end edges of the first and second hollow shafts extend in a circumferential direction instead of in a radial direction in a sidewall surface of the first or second hollow support shaft.

6. The foundation support system of claim 1, wherein the first and second hollow support shafts are formed with a uniform wall thickness along an entirety of the first axial length and the second axial length.

7. The foundation support system of claim 1, wherein the first and second hollow support shaft have one of a circular cross-sectional shape, a square cross-sectional shape or a hexagonal cross-sectional shape.

8. The foundation support system of claim 1, wherein each of the first and second profiled distal end edges defines an undulating engagement surface.

9. The foundation support system of claim 8, wherein each undulating engagement surface includes alternating arch-shaped cavities and arch-shaped extensions.

10. The foundation support system of claim 9, wherein the arch-shaped extensions and arch-shaped cavities are defined by parabolic curvature.

11. The foundation support system of claim 1, wherein each of the first and second profiled distal end edges define alternating rectangular-shaped cavities and rectangular-shaped extensions.

12. The foundation support system of claim 1, wherein each of the first and second profiled distal end edges define alternating triangular-shaped cavities and triangular-shaped extensions.

13. The foundation support system of claim 1, wherein the hollow sleeve surrounds a circumference of the directly abutted and engaged first and second profiled distal end edges.

14. The foundation support system of claim 13, wherein the second hollow support shaft includes a first pair of fastener holes and wherein the hollow sleeve includes a second pair of fastener holes, the first and second pairs of fastener holes becoming self-aligned when the first and second profiled distal ends are directly abutted and engaged.

15. The foundation support system of claim 1, further comprising a second fastener attaching the hollow sleeve to the second hollow support shaft.

16. The foundation support system of claim 15, wherein the first fastener and the second fastener extend in perpendicular orientations to one another.

17. The foundation support system of claim 1, wherein the hollow sleeve has one of a circular cross-sectional shape, a square cross-sectional shape or a hexagonal cross-sectional shape.

18. The foundation support system of claim 1, wherein the hollow sleeve is formed with an axial length, and wherein the hollow sleeve is further formed with a uniform wall thickness along an entirety of the axial length.

19. The foundation support system of claim 1, further comprising a cap, a plate, or a lift bracket to support a building foundation in combination with the coupled shaft assembly.

20. The foundation support system of claim 1, in combination with a grout or cementitious material to enhance a structural strength and capacity of the coupled shaft assembly in the installed foundation support system.

21. The foundation support system of claim 1, wherein the first and second hollow support shafts are steel shafts.

22. The foundation support system of claim 1, wherein one of the first and second hollow support shafts includes a helical auger.

23. The foundation support system of claim 1, wherein the first and second profiled distal end edges include alternating cavities and extensions.

24. The foundation support system of claim 23, wherein the alternating cavities and extensions are symmetrical.

25. The foundation support system of claim 24, wherein the alternating cavities and extensions are arch-shaped.

26. The foundation support system of claim 24, wherein the alternating cavities and extensions are rectangular-shaped.

27. The foundation support system of claim 24, wherein the alternating cavities and extensions are triangular-shaped.

28. The foundation support system of claim 1, wherein the first and second profiled distal end edges include at least one symmetrical extension.

29. The foundation support system of claim 28, wherein the first and second profiled distal end edges further include at least one symmetrical cavity.

30. A foundation support system comprising:

a coupled shaft assembly comprising:

a first hollow support shaft formed with a first axial length and a first profiled distal end edge;

a second hollow support shaft formed with a second axial length and a second profiled distal end edge;

a hollow sleeve that is slidably movable relative to the first hollow support shaft after the first hollow support shaft is driven to a first depth in an installation of the foundation support system; and a first fastener attaching the hollow sleeve to the first hollow support shaft and maintaining the first profiled distal end edge in a fixed position relative to the sleeve;

wherein when the second profiled distal end edge is slidably engaged to the sleeve and directly abutted and engaged to the first profiled distal end edge, a torque transmitting connection is established between the first hollow support shaft and the second hollow support shaft in order to drive the coupled shaft assembly to a second depth in the installation of the foundation support system;

wherein the hollow sleeve is formed with an axial length, and the sleeve further formed with a uniform wall thickness along an entirety of the axial length; and wherein the hollow sleeve is formed with a first pair of fastener openings to receive the first fastener extended through the first pair of fastener openings, the first pair of fastener openings including a first opening having a first shape and a second opening having a different shape than the first shape.

31. The foundation support system of claim 30, wherein the first shape includes polygonal edges.

32. The foundation support system of claim 30, wherein the second shape is an oval shape.

33. A foundation support system comprising:

a coupled shaft assembly comprising:

a first hollow support shaft having a first axial length, a first profiled distal end edge, and a uniform sidewall thickness along an entirety of the first axial length including the first profiled distal end edge;

a second hollow support shaft having a second axial length, a second profiled distal end edge, and a uniform sidewall thickness along an entirety of the second axial length including the second profiled distal end edge;

a hollow sleeve having a third axial length and a uniform sidewall thickness along an entirety of the third axial length;

wherein the hollow sleeve is slidably movable relative to the first hollow support shaft and relative to the second hollow support shaft, the hollow sleeve configured to receive and surround each of the first and second profiled distal end edges when directly abutted and maintain a torque transmitting connection therebetween in order to secure the coupled shaft assembly at a desired depth in an installation of the foundation support system; and at least one fastener insertable through the sidewall of the hollow sleeve and through the sidewall of one of the first hollow support shaft and the second hollow support shaft, wherein the at least one is mechanically isolated from torque transmission in the coupled shaft assembly.

34. The foundation support system of claim 33, wherein each of the first and second profiled distal end edges includes alternating cavities and extensions.

35. The foundation support system of claim 34, wherein the alternating cavities and extensions are selected from the group of arch-shaped cavities and extensions, rectangular-shaped cavities and extensions, and triangular-shaped cavities and extensions.

36. The foundation support system of claim 34, wherein the alternating cavities and extensions are symmetrical.

37. The foundation support system of claim 34, wherein the alternating cavities and extensions include convex or concave portions.

38. The foundation support system of claim 33, wherein each of the first hollow support shaft and the second hollow support shaft have a circular outer diameter and a circular inner diameter.

39. The foundation support system of claim 33, wherein the at least one fastener comprises a first bolt insertable through the hollow sleeve and through the first hollow support shaft, and a second bolt insertable through the hollow sleeve and through the second hollow support shaft.

40. The foundation support system of claim 39, wherein the first bolt and second bolt establish a cross-bolt connection of the hollow sleeve, the first hollow support shaft and the second hollow support shaft.

* * * * *